US009012751B2

(12) United States Patent
Ruttenberg

(10) Patent No.: US 9,012,751 B2
(45) Date of Patent: Apr. 21, 2015

(54) HINGED DRUMSTICK

(71) Applicant: HingeStix LLC, Cherry Hill, NJ (US)

(72) Inventor: Samuel Ruttenberg, Cherry Hill, NJ (US)

(73) Assignee: HingeStix LLC, Cherry Hill, NJ (US)

( * ) Notice: Subject to any disclaimer, the term of this patent is extended or adjusted under 35 U.S.C. 154(b) by 0 days.

(21) Appl. No.: 13/872,202

(22) Filed: Apr. 29, 2013

(65) Prior Publication Data

US 2013/0291707 A1 Nov. 7, 2013

Related U.S. Application Data

(63) Continuation-in-part of application No. 13/772,837, filed on Feb. 21, 2013, which is a continuation-in-part of application No. 13/314,244, filed on Dec. 8, 2011, now Pat. No. 8,618,397, which is a continuation-in-part of application No. 12/774,408, filed on May 5, 2010, now Pat. No. 8,253,003, which is a continuation-in-part of application No. 12/610,670, filed on Nov. 2, 2009, now Pat. No. 7,897,859.

(60) Provisional application No. 61/184,467, filed on Jun. 5, 2009.

(51) Int. Cl.
*G10D 13/02* (2006.01)
*G10D 13/00* (2006.01)

(52) U.S. Cl.
CPC ..... *G10D 13/003* (2013.01)

(58) Field of Classification Search
CPC ..... G10D 13/003
See application file for complete search history.

(56) References Cited

U.S. PATENT DOCUMENTS

| | | | |
|---|---|---|---|
| 1,362,769 | A | 12/1920 | White |
| 1,481,596 | A | 1/1924 | Fletcher et al. |
| 2,521,336 | A | 9/1950 | Bramson |
| D206,134 | S | 11/1966 | Gussak |
| 3,365,108 | A | 1/1968 | Giba |
| 3,859,887 | A | 1/1975 | Buchanan |
| 3,866,508 | A | 2/1975 | Huslig |
| 3,893,364 | A | 7/1975 | Harrison |
| 4,269,105 | A | 5/1981 | Salmon |

(Continued)

OTHER PUBLICATIONS

Notice of Allowance for U.S. Appl. No. 13/314,244, mailed Jul. 24, 2013.

(Continued)

*Primary Examiner* — Robert W Horn
(74) *Attorney, Agent, or Firm* — Pergament Gilman & Cepeda LLP

(57) ABSTRACT

A percussion instrument is disclosed that may include a body having a longitudinal axis extending from a butt end to a striking end thereof and at least one hole extending through the thickness of the body substantially along or through an axis that is different from the longitudinal axis; and a grasping mechanism having a first grip plate at a first end thereof and a second grip plate at a second end thereof, and at least one shaft extending through the hole. The percussion instrument may further include a compliance mechanism disposed between the first and second grip plates, enabling the first and second grip plates to move closer together in response to a compressive force applied. One or more recesses or bores may be used for a more compact design, and the at least one hole may be on an angle to accommodate different drumming styles.

26 Claims, 17 Drawing Sheets

(56) References Cited

U.S. PATENT DOCUMENTS

| | | | | |
|---|---|---|---|---|
| 5,370,030 | A | 12/1994 | Horne | |
| 5,503,056 | A | 4/1996 | Evans | |
| D386,779 | S | 11/1997 | Burgos | |
| 6,271,451 | B1 | 8/2001 | Gress | |
| 6,346,662 | B1 | 2/2002 | Sielaff | |
| 6,365,813 | B1 | 4/2002 | Gress | |
| D473,259 | S | 4/2003 | Izen et al. | |
| 6,924,423 | B2 | 8/2005 | O'Donnell | |
| 7,173,176 | B2 | 2/2007 | Nybye | |
| 7,323,627 | B2 | 1/2008 | Sweeney | |
| 7,375,271 | B1 | 5/2008 | Zelinsky | |
| 7,435,889 | B1 | 10/2008 | Heidt | |
| 7,473,836 | B2 | 1/2009 | Barke | |
| 7,897,859 | B2 | 3/2011 | Ruttenberg | |
| 7,960,635 | B2 | 6/2011 | Rice | |
| 7,968,782 | B2 | 6/2011 | Mackie | |
| 8,253,003 | B2 * | 8/2012 | Ruttenberg | 84/422.4 |
| 8,618,397 | B2 * | 12/2013 | Ruttenberg | 84/422.4 |
| 8,748,722 | B2 * | 6/2014 | Ruttenberg | 84/422.4 |
| 2009/0007755 | A1 | 1/2009 | Rivers, Jr. | |
| 2010/0058919 | A1 | 3/2010 | Rice | |
| 2010/0307317 | A1 | 12/2010 | Ruttenberg | |
| 2010/0307318 | A1 | 12/2010 | Ruttenberg | |
| 2012/0073422 | A1 * | 3/2012 | Ruttenberg | 84/422.4 |
| 2013/0192443 | A1 | 8/2013 | Ruttenberg | |
| 2013/0291707 | A1 * | 11/2013 | Ruttenberg | 84/422.4 |

OTHER PUBLICATIONS

Notice of Allowance for U.S. Appl. No. 12/610,670, dated Dec. 21, 2010.
Office Action for U.S. Appl. No. 12/774,408, dated Jan. 18, 2012.
Office Action for U.S. Appl. No. 12/774,408, dated Apr. 20, 2012.
Notice of Allowance and Interview Summary for U.S. Appl. No. 12/774,408, dated Jun. 25, 2012.
Interview Summary clarifying reasons for allowance for U.S. Appl. No. 12/774,408, dated Jul. 17, 2012.
Office Action for U.S. Appl. No. 13/314,244, dated Feb. 6, 2013.
Interview Summary for U.S. Appl. No. 13/314,244, dated Apr. 11, 2013.
Notice of Allowance for U.S. Appl. No. 13/314,244, dated Jul. 24, 2013.
Interview Summary clarifying reasons for allowance for U.S. Appl. No. 13/314,244, dated Aug. 14, 2013.
Office Action for U.S. Appl. No. 12/774,408, mailed Jan. 18, 2012.
Office Action for U.S. Appl. No. 12/774,408, mailed Apr. 20, 2012.
Notice of Allowance for U.S. Appl. No. 12/774,408, mailed Jun. 25, 2012.
Office Action for U.S. Appl. No. 13/314,244, mailed Feb. 6, 2013.
Notice of Allowance for U.S. Appl. No. 12/610,670, mailed Dec. 21, 2010.
Notice of Allowance for U.S. Appl. No. 13/772,837, dated Mar. 19, 2014.

* cited by examiner

HINGED DRUMSTICK

CROSS-REFERENCE TO RELATED APPLICATIONS

This application is a Continuation-in-Part of U.S. Non-Provisional patent application Ser. No. 13/772,837, filed Feb. 21, 2013, and presently pending, which is a Continuation-in-Part of U.S. Non-Provisional patent application Ser. No. 13/314,244, filed Dec. 8, 2011, and presently pending, entitled "Hinged Drumstick", which is a Continuation-in-Part of U.S. Non-Provisional patent application Ser. No. 12/774,408, filed May 5, 2010, entitled "Hinged Drumstick", which has issued as U.S. Pat. No. 8,253,003 on Aug. 28, 2012, and which is a Continuation-in-Part of U.S. Non-Provisional application Ser. No. 12/610,670, filed Nov. 2, 2009, entitled "Hinged Drumstick" which application has issued as U.S. Pat. No. 7,897,859 on Mar. 1, 2011, and claims the benefit of U.S. Provisional Patent Application Ser. No. 61/184,467, filed Jun. 5, 2009, entitled "Ruttenberg's Hinge Drumstick", the entire disclosures of which applications and patents are hereby incorporated by reference herein.

BACKGROUND OF THE INVENTION

This invention relates in general to musical percussion instruments, and more particularly to drumsticks for playing percussion instruments.

Drumsticks typically include a butt end, a striking end, and an intermediate region located in between the butt end and the striking end along the length of the body of the drumstick. The intermediate region generally includes a balance point (fulcrum) about which the drumstick pivots when the tip or striking point of the drumstick rebounds from contact with a drum skin (i.e. a head).

The drumstick is generally held at or near the balance point during use, since gripping the stick at this point enables maximum motion of the stick as it strikes and then rebounds from the surface of a drum or other percussion device. When held too tightly there is too much friction, and the player inhibits the motion (rebound) of the drumstick. In order to properly train students learning to play percussion instruments, such as, for instance, a snare drum, it is helpful not only to aid the student in grasping the stick at the balance point, but to encourage gripping of the stick in the proper manner. The latter is of particular importance in learning a technique in which the stick is effectively hinged between the thumb and forefinger of the user's hand, and the last three fingers of the hand controlling the rate of movement of the stick are located underneath the drumstick to control the speed of motion.

Drumsticks have been devised which attempt to minimize friction which slows down the motion (rebound) of the drumstick, for example, by isolating of the body of the drumstick from the fingers with some resilient material which can be gripped with firmness and which will not completely inhibit free motion of the drumstick. Another approach has been to provide some form of locator at the balance point. However, such designs do not establish freedom from restraint in pivotal movement as the stick rebounds from the drum. Moreover, they do not facilitate grasping and control of the drumstick at the balance point, especially for the student learning the fingertip control method of playing drums.

The aforementioned problem relates generally to drumming but may be particularly relevant depending on how a user wishes to use a drumstick, particularly with respect to one or more drumming styles. In drumming, the traditional grip (also called rudimental) style is typically used for the left hand (i.e., where a portion of the left hand is positioned substantially under the drumstick). The right hand may stay on top of the other corresponding drumstick as in the matched grip. Historically, such a drumming style developed during times of war because, when soldiers were marching into battle, the drum would be slung over the shoulder of the drummer and would rest on the left leg of the drummer. Such a configuration caused the drum to tilt at an angle whereby having the left hand on top of the stick (like the right hand for the other corresponding drumstick) would cause the drummer's elbow to stick out in the air and cause fatigue. The solution was to hold the stick in the left hand underneath the stick such that the drumstick would rest in the drummer's hand between the thumb and the third and fourth fingers of the left hand. This traditional grip is still used today in marching drumming in Jazz drumming.

Thus, it is a problem in the art that prior approaches to providing unrestrained pivotal motion of the drumstick do not also enable a user to exercise sufficient control over the drumstick.

An additional problem is that one stick does not exist that permits users thereof to exercise sufficient control over the drumstick while performing multiple types of drumming styles, such as, but not limited to, the traditional, left hand gripping style; the right hand, matched gripping style; the French style; etc. As such, there is a need in the industry for a stick that allows users to perform multiple drumming styles either without modifying the stick in order to change between drumming styles or including structure such that a user may make a simple modification to the stick without requiring or using any additional components or parts for the stick.

SUMMARY OF THE INVENTION

According to one aspect, the present invention is directed to a percussion instrument that may include a body having a longitudinal axis extending from a butt end to a striking end thereof and at least two holes extending through the thickness of the body substantially along and/or through a respective axis that is different from the longitudinal axis and that is different from the axis of the other hole of the at least two holes; at least one grasping mechanism having a first grip plate at a first end thereof and a second grip plate at a second end thereof, at least one shaft extending from the first grip plate through a first hole of the at least two holes in the body to the second grip plate, and a releasable connection between the first grip plate and the second grip plate such that the at least one grasping mechanism operates to be positioned in the first hole of the at least two holes and the first grip plate and the second grip plate operate to be disconnected from each other and/or connected/re-connected to each other such that the at least one grasping mechanism operates to be positioned in a second hole of the at least two holes and/or re-positioned in the first hole of the at least two holes; and a compliance mechanism disposed between the first and second grip plates, enabling the first and second grip plates to be moved closer together in response to a compressive force applied to the at least one grasping mechanism.

The releasable connection may include at least one of: a screw; a threaded connection; a snap or press fit connection and a friction fit connection.

Preferably, at least one of the following may occur or be included: (i) the first hole is sized and shaped such that the at least one grasping mechanism operates to permit a user of the percussion instrument to hold the body in, or to perform in, at least one of: the French grip style and the right handed, matched grip style; (ii) the second hole is sized and shaped such that the at least one grasping mechanism operates to permit the user of the percussion instrument to hold the body in, or to perform in, the traditional, left-hand drumming grip style; and (iii) the at least one grasping mechanism comprises a first and a second grasping mechanism; the first hole being sized and shaped such that the first grasping mechanism of the at least one grasping mechanism operates to be disposed in the first hole and to permit a user of the percussion instrument to hold the body in, or to perform in, at least one of: the French grip style and the right handed, matched grip style; and the second hole being sized and shaped such that the second grasping mechanism of the at least one grasping mechanism operates to be disposed in the second hole and to permit the user of the percussion instrument to hold the body in, or to perform in, the traditional, left-hand drumming grip style, wherein the first and second grasping mechanisms operate to permit the user to switch between the first and second grasping mechanisms, thereby allowing the user to comfortably and/or conveniently perform all of the different drumming styles achievable when using the first grasping mechanism or the second grasping mechanism.

The first hole of the at least two holes extending through the thickness of the body may be disposed at least one of: at a right angle in relation to the longitudinal axis, at substantially a right angle in relation to the longitudinal axis, transversely to the longitudinal axis, substantially transversely to the longitudinal axis, at an angle that is about ninety degrees with respect to the body and at an angle that is ninety degrees with respect to the body. The second hole of the at least two holes extending through the thickness of the body may be disposed at least one of: at an angle different from the angle of the first hole, at an angle that is not a right angle in relation to the longitudinal axis, at an angle that is not substantially a right angle in relation to the longitudinal axis, not transversely to the longitudinal axis, not substantially transversely to the longitudinal axis, at an angle other than about ninety degrees with respect to the body and at an angle other than ninety degrees with respect to the body. The angle of the first hole of the at least two holes may be at least one of: positioned between about 80 degrees and about 100 degrees with respect to the first side, the second side or the longitudinal axis of the body; positioned at about 90 degrees with respect to the first side, the second side or the longitudinal axis of the body; positioned at substantially 90 degrees with respect to the first side, the second side or the longitudinal axis of the body and positioned at 90 degrees with respect to the first side, the second side or the longitudinal axis of the body; and the angle of the second hole of the at least two holes may be at least one of: positioned between about 80 degrees and about 45 degrees with respect to the first side or the second side, positioned between about 80 degrees and about 40 degrees with respect to the first side or the second side, positioned between about 70 degrees and about 45 degrees with respect to the first side or the second side, positioned between about 60 degrees and about 45 degrees w with respect to the first side or the second side, positioned between about 50 degrees and about 45 degrees with respect to the first side or the second side, positioned at about 80 degrees with respect to the first side or the second side, positioned at about 75 degrees with respect to the first side or the second side, positioned at about 70 degrees with respect to the first side or the second side, positioned at about 65 degrees with respect to the first side or the second side, positioned at about 60 degrees with respect to with respect to the first side or the second side, positioned at about 55 degrees with respect to with respect to the first side or the second side, positioned at about 50 degrees with respect to the first side or the second side, positioned at about 45 degrees with respect to the first side or the second side, positioned at about 40 degrees with respect to the first side or the second side, positioned at about 35 degrees with respect to the first side or the second side, positioned at about 30 degrees with respect to the first side or the second side, positioned between about 105 degrees and about 110 degrees with respect to the first side or the second side, positioned between about 105 degrees and about 120 degrees with respect to the first side or the second side, positioned between about 105 degrees and about 130 degrees with respect to the first side or the second side, positioned between about 105 degrees and about 140 degrees with respect to the first side or the second side, positioned between about 105 degrees and about 150 degrees with respect to the first side or the second side, positioned between about 105 degrees and about 160 degrees with respect to the first side or the second side, positioned between about 105 degrees and about 170 degrees with respect to the first side or the second side, positioned at about 105 degrees with respect to the first side or the second side, positioned at about 110 degrees with respect to the first side or the second side, positioned at about 115 degrees with respect to the first side or the second side, positioned at about 120 degrees with respect to the first side or the second side, positioned at about 125 degrees with respect to the first side or the second side, positioned at about 130 degrees with respect to the first side or the second side, positioned at about 135 degrees with respect to the first side or the second side, positioned at about 140 degrees with respect to the first side or the second side, positioned at about 145 degrees with respect to the first side or the second side, positioned at about 150 degrees with respect to the first side or the second side, positioned at about 155 degrees with respect to the first side or the second side, positioned at about 160 degrees with respect to the first side or the second side, positioned at about 165 degrees with respect to the first side or the second side, positioned at about 170 degrees with respect to the first side or the second side, and positioned at about 175 degrees with respect to the first side or the second side.

The body may include at least a first side extending between the butt end and the striking end of the body and at least a second side extending between the butt end and the striking end of the body.

In one or more embodiments, at least one of may occur or be included: (i) the first hole of the at least two holes may include at least one recess or bore disposed or located substantially at an end of the first hole, the at least one recess or bore being sized and/or shaped to receive at least a portion of at least one of the first grip plate and the second grip plate therein such that the at least one recess or bore operates to permit the first grip plate and/or the second grip plate to be positioned at least one of: (a) closer to each other than when not having the at least one recess or bore; and/or (b) closer to the surface of the body of the percussion instrument; (ii) the second hole of the at least two holes may include at least one recess or bore disposed or located substantially at an end of the first hole, the at least one recess or bore being sized and/or shaped to receive at least a portion of at least one of the first grip plate and the second grip plate therein such that the at least one recess or bore operates to permit the first grip plate and/or the second grip plate to be positioned at least one of: (a) closer to each other than when not having the at least one recess or bore; and/or (b) closer to the surface of the body of the percussion instrument; (iii) the first hole of the at least two holes includes at least one of: (a) a first recess or bore of the at least one recess or bore at a first end of the first hole operating to permit at least a portion of the first grip plate to be disposed therein; and (b) a second recess or bore of the at least one recess or bore at a second end of the first hole operating to permit at least a portion of the second grip plate to be disposed therein; and (iv) the second hole of the at least two holes includes at least one of: (a) a first recess or bore of the at least one recess or bore at a first end of the first hole operating to permit at least a portion of the first grip plate to be disposed therein; and (b) a second recess or bore of the at least one recess or bore at a second end of the first hole operating to permit at least a portion of the second grip plate to be disposed therein.

In one or more embodiments, at least one of the following may occur or be included: (i) at least one of the first grip plate and the second grip plate includes a pad thereon, the pad operating to provide a comfortable and/or ergonomic surface for gripping at least the at least one grasping mechanism of the percussion instrument; (ii) the pad includes at least one surface that is at least one of: curved, sloped, chamfered, convex, concave, rounded, substantially flat, recessed, parallel or substantially parallel to the longitudinal axis of the body, and disposed at an angle that is not parallel or substantially parallel to the longitudinal axis of the body; (iii) at least one of the first grip plate and the second grip plate includes at least one surface that is at least one of: curved, sloped, chamfered, convex, concave, rounded, substantially flat, recessed, parallel or substantially parallel to the longitudinal axis of the body, and disposed at an angle that is not parallel or substantially parallel to the longitudinal axis of the body; (iv) the first grip plate and the second grip plate each include a pad thereon, the pad operating to provide a comfortable and/or ergonomic surface for gripping at least the at least one grasping mechanism of the percussion instrument; (v) the first grip plate and the second grip plate each include gripping surfaces thereon, the gripping surface of the first grip plate being substantially parallel or parallel to the gripping surface of the second grip plate; and (vi) the pad of the first grip plate and the pad of the second grip plate each including gripping surfaces thereon, the gripping surface of the pad of the first grip plate being substantially parallel or parallel to the gripping surface of the pad of the second grip plate.

The first hole of the at least two holes and/or the second hole of the at least two holes may be sized and shaped to operate to at least one of: permit the at least one grasping mechanism and/or the compliance mechanism to be positioned therein such that a zone of space of a predetermined size is located between the first hole of the at least two holes and/or the second hole of the at least two holes and the at least one grasping mechanism and/or the compliance mechanism, thereby permitting the at least one grasping mechanism and/or the compliance mechanism to move freely within the first hole of the at least two holes and/or the second hole of the at least two holes; permit the at least one grasping mechanism and/or the compliance mechanism to be positioned therein such that a zone of space of a predetermined size is located between the first hole of the at least two holes and/or the second hole of the at least two holes and the at least one grasping mechanism and/or the compliance mechanism, thereby permitting the at least one grasping mechanism and/or the compliance mechanism to move freely in at least a direction that is substantially along the length of the first hole of the at least two holes and/or the second hole of the at least two holes within the first hole of the at least two holes and/or the second hole of the at least two holes; permit the at least one grasping mechanism and/or the compliance mechanism to be positioned therein and to be spaced away therefrom such that the at least one grasping mechanism and/or the compliance mechanism operates to make one or more audible noises when hitting against the first hole of the at least two holes and/or the second hole of the at least two holes, thereby permitting the at least one grasping mechanism and/or the compliance mechanism to move freely within the first hole of the at least two holes and/or the second hole of the at least two holes; permit the at least one grasping mechanism and/or the compliance mechanism to be positioned therein and to be spaced away therefrom such that the at least one grasping mechanism and/or the compliance mechanism operates to make one or more audible noises when hitting against the first hole of the at least two holes and/or the second hole of the at least two holes, thereby permitting the at least one grasping mechanism and/or the compliance mechanism to move freely in at least a direction that is substantially along the length of the first hole of the at least two holes and/or the second hole of the at least two holes within the first hole of the at least two holes and/or the second hole of the at least two holes; and permit the at least one grasping mechanism and/or the compliance mechanism to be positioned therein and to be in contact with at least a portion thereof.

At least one of the first and second grip plates may have a first substantially flat or flat surface facing the body, a second surface or perimeter wall extending from the flat surface facing the body at a right angle or at an angle that is about 90 degrees, a third surface extending from the second surface or perimeter wall, the first surface being disposed adjacent to or near the body such that rattling of the at least one grasping mechanism within the body is reduced and/or minimized, the third surface being sloped and/or tapered and extending to a fourth flat surface, the fourth flat surface having a length or a diameter that is smaller or shorter than the length or the diameter of the longest section of the at least one of the first and second grip plates. Additionally or alternatively, at least one of the first and second grip plates may have a first substantially flat or flat surface facing the body, a second surface or perimeter wall extending from the flat surface facing the body at a right angle or at an angle that is about 90 degrees, and a third surface extending from the second surface or perimeter wall, the first surface being disposed adjacent to or near the body such that rattling of the at least one grasping mechanism within the body is reduced and/or minimized, the third surface being sloped and/or tapered and extending from the second surface or perimeter wall in an uninterrupted fashion such that the sloped and/or tapered third surface extends at least one of: (a) radially from at least one side to another side of the second surface or perimeter wall; and (b) radially from all sides to all other sides of the second surface or perimeter wall all along the circumference of the second surface or perimeter wall. Additionally or alternatively, at least one of the first and second grip plates may have a first substantially flat or flat surface facing the body, a second surface or perimeter wall extending from the flat surface facing the body at a right angle or at an angle that is about 90 degrees, a third surface extending from the second surface or perimeter wall, the third surface being sloped and/or tapered and extending to a fourth flat surface, the fourth flat surface having a length or a diameter that is smaller or shorter than the length or the diameter of the longest section of the at least one of the first and second grip plates. Additionally or alternatively, at least one of the first and second grip plates may have a first substantially flat or flat surface facing the body, a second surface or perimeter wall extending from the flat surface facing the body at a right angle or at an angle that is about 90 degrees, a third surface extending from the second surface or perimeter wall, the third surface being sloped and/or tapered and extending from the second surface or perimeter wall in an uninterrupted fashion such that the sloped and/or tapered third surface extends at least one of: (a) radially from at least one side to another side of the second surface or perimeter wall; and (b) radially from all sides to all other sides of the second surface or perimeter wall all along the circumference of the second surface or perimeter wall.

One or more components of at least one of the at least one grasping mechanism, the compliance mechanism and the body may be made of at least one of: wood, plastic, metal, rubber, hard rubber, polytetrafluoroethylene, carbon fiber, and fiber.

In one or more embodiments, at least one of the following may occur or be included: (i) the at least one shaft of the at least one grasping mechanism is substantially stationary or fixed in a predetermined position within the first hole of the at least two holes and/or the second hole of the at least two holes and at least one of the first grip plate and the second grip plate are connected to the at least one shaft such that the at least one of the first grip plate and the second grip plate at least one of spin, rotate, swivel and tilt on respective ends of the at least one grasping mechanism; (ii) the at least one shaft of the at least one grasping mechanism is substantially stationary or fixed in a predetermined position within the first hole of the at least two holes and/or the second hole of the at least two holes and at least one of the first grip plate and the second grip plate are connected to the at least one shaft such that the at least one of the first grip plate and the second grip plate at least one of spin, rotate, swivel and tilt on respective ends of the at least one grasping mechanism, wherein the connection between the at least one shaft and the at least one of the first grip plate and the second grip plate comprises at least one of: a screw, a nail, a ball-snap combination, a pin-bearing combination, and a pin-ball bearing combination; (iii) at least a portion of the at least one shaft of the at least one grasping mechanism is in contact with at least a portion of an inside wall of the first hole of the at least two holes and/or the second hole of the at least two holes such that the at least one shaft is substantially stationary or fixed in a predetermined position within the first hole of the at least two holes and/or the second hole of the at least two holes; (iv) at least one of the first grip plate and the second grip plate are connected to the at least one shaft such that the at least one of the first grip plate and the second grip plate at least one of spin, rotate, swivel and tilt on respective ends of the at least one grasping mechanism; and (v) the at least one shaft is integral with the body.

According to another aspect, the invention is directed to a percussion instrument that may include a body having a longitudinal axis extending from a butt end to a striking end thereof and at least two holes extending through the thickness of the body substantially along and/or through a respective axis that is different from the longitudinal axis and that is different from the axis of the other hole of the at least two holes; and at least one grasping mechanism having a first grip plate at a first end thereof and a second grip plate at a second end thereof, at least one shaft extending from the first grip plate through a first hole of the at least two holes in the body to the second grip plate, and a releasable connection between the first grip plate and the second grip plate such that the at least one grasping mechanism operates to be positioned in the first hole of the at least two holes and the first grip plate and the second grip plate operate to be disconnected from each other and/or connected/re-connected to each other such that the at least one grasping mechanism operates to be positioned in a second hole of the at least two holes and/or re-positioned in the first hole of the at least two holes.

In one or more embodiments, at least one of the following may occur or be included: (i) the first hole is sized and shaped such that the at least one grasping mechanism operates to permit a user of the percussion instrument to hold the body in, or to perform in, at least one of: the French grip style and the right handed, matched grip style; (ii) the second hole is sized and shaped such that the at least one grasping mechanism operates to permit the user of the percussion instrument to hold the body in, or to perform in, the traditional, left-hand drumming grip style; and (iii) the at least one grasping mechanism comprises a first and a second grasping mechanism; the first hole being sized and shaped such that the first grasping mechanism of the at least one grasping mechanism operates to be disposed in the first hole and to permit a user of the percussion instrument to hold the body in, or to perform in, at least one of: the French grip style and the right handed, matched grip style; and the second hole being sized and shaped such that the second grasping mechanism of the at least one grasping mechanism operates to be disposed in the second hole and to permit the user of the percussion instrument to hold the body in, or to perform in, the traditional, left-hand drumming grip style, wherein the first and second grasping mechanisms operate to permit the user to switch between the first and second grasping mechanisms, thereby allowing the user to comfortably and/or conveniently perform all of the different drumming styles achievable when using the first grasping mechanism or the second grasping mechanism.

The first hole of the at least two holes extending through the thickness of the body may be disposed at least one of: at a right angle in relation to the longitudinal axis, at substantially a right angle in relation to the longitudinal axis, transversely to the longitudinal axis, substantially transversely to the longitudinal axis, at an angle that is about ninety degrees with respect to the body and at an angle that is ninety degrees with respect to the body. The second hole of the at least two holes extending through the thickness of the body may be disposed at least one of: at an angle different from the angle of the first hole, at an angle that is not a right angle in relation to the longitudinal axis, at an angle that is not substantially a right angle in relation to the longitudinal axis, not transversely to the longitudinal axis, not substantially transversely to the longitudinal axis, at an angle other than about ninety degrees with respect to the body and at an angle other than ninety degrees with respect to the body. The angle of the first hole of the at least two holes may be at least one of: positioned between about 80 degrees and about 100 degrees with respect to the first side, the second side or the longitudinal axis of the body; positioned at about 90 degrees with respect to the first side, the second side or the longitudinal axis of the body; positioned at substantially 90 degrees with respect to the first side, the second side or the longitudinal axis of the body and positioned at 90 degrees with respect to the first side, the second side or the longitudinal axis of the body. The angle of the second hole of the at least two holes may be at least one of: positioned between about 80 degrees and about 45 degrees with respect to the first side or the second side, positioned between about 80 degrees and about 40 degrees with respect to the first side or the second side, positioned between about 70 degrees and about 45 degrees with respect to the first side or the second side, positioned between about 60 degrees and about 45 degrees w with respect to the first side or the second side, positioned between about 50 degrees and about 45 degrees with respect to the first side or the second side, positioned at about 80 degrees with respect to the first side or the second side, positioned at about 75 degrees with respect to the first side or the second side, positioned at about 70 degrees with respect to the first side or the second side, positioned at about 65 degrees with respect to the first side or the second side, positioned at about 60 degrees with respect to with respect to the first side or the second side, positioned at about 55 degrees with respect to with respect to the first side or the second side, positioned at about 50 degrees with respect to the first side or the second side, positioned at about 45 degrees with respect to the first side or the second side, positioned at about 40 degrees with respect to the first side or the second side, positioned at about 35 degrees with respect to the first side or the second side, positioned at about 30 degrees with respect to the first side or the second side, positioned between about 105 degrees and about 110 degrees with respect to the first side or the second side, positioned between about 105 degrees and about 120 degrees with respect to the first side or the second side, positioned between about 105 degrees and about 130 degrees with respect to the first side or the second side, positioned between about 105 degrees and about 140 degrees with respect to the first side or the second side, positioned between about 105 degrees and about 150 degrees with respect to the first side or the second side, positioned between about 105 degrees and about 160 degrees with respect to the first side or the second side, positioned between about 105 degrees and about 170 degrees with respect to the first side or the second side, positioned at about 105 degrees with respect to the first side or the second side, positioned at about 110 degrees with respect to the first side or the second side, positioned at about 115 degrees with respect to the first side or the second side, positioned at about 120 degrees with respect to the first side or the second side, positioned at about 125 degrees with respect to the first side or the second side, positioned at about 130 degrees with respect to the first side or the second side, positioned at about 135 degrees with respect to the first side or the second side, positioned at about 140 degrees with respect to the first side or the second side, positioned at about 145 degrees with respect to the first side or the second side, positioned at about 150 degrees with respect to the first side or the second side, positioned at about 155 degrees with respect to the first side or the second side, positioned at about 160 degrees with respect to the first side or the second side, positioned at about 165 degrees with respect to the first side or the second side, positioned at about 170 degrees with respect to the first side or the second side, and positioned at about 175 degrees with respect to the first side or the second side.

The body may include at least a first side extending between the butt end and the striking end of the body and at least a second side extending between the butt end and the striking end of the body.

The releasable connection may include at least one of: a screw; a threaded connection; a snap or press fit connection and a friction fit connection.

In one or more embodiments, at least one of the following may occur or be included: (i) the first hole of the at least two holes includes at least one recess or bore disposed or located substantially at an end of the first hole, the at least one recess or bore being sized and/or shaped to receive at least a portion of at least one of the first grip plate and the second grip plate therein such that the at least one recess or bore operates to permit the first grip plate and/or the second grip plate to be positioned at least one of: (a) closer to each other than when not having the at least one recess or bore; and/or (b) closer to the surface of the body of the percussion instrument; (ii) the second hole of the at least two holes includes at least one recess or bore disposed or located substantially at an end of the first hole, the at least one recess or bore being sized and/or shaped to receive at least a portion of at least one of the first grip plate and the second grip plate therein such that the at least one recess or bore operates to permit the first grip plate and/or the second grip plate to be positioned at least one of: (a) closer to each other than when not having the at least one recess or bore; and/or (b) closer to the surface of the body of the percussion instrument; (iii) the first hole of the at least two holes includes at least one of: (a) a first recess or bore of the at least one recess or bore at a first end of the first hole operating to permit at least a portion of the first grip plate to be disposed therein; and (b) a second recess or bore of the at least one recess or bore at a second end of the first hole operating to permit at least a portion of the second grip plate to be disposed therein; and (iv) the second hole of the at least two holes includes at least one of: (a) a first recess or bore of the at least one recess or bore at a first end of the first hole operating to permit at least a portion of the first grip plate to be disposed therein; and (b) a second recess or bore of the at least one recess or bore at a second end of the first hole operating to permit at least a portion of the second grip plate to be disposed therein.

In one or more embodiments, at least one of the following may occur or be included: (i) at least one of the first grip plate and the second grip plate includes a pad thereon, the pad operating to provide a comfortable and/or ergonomic surface for gripping at least the at least one grasping mechanism of the percussion instrument; (ii) the pad includes at least one surface that is at least one of: curved, sloped, chamfered, convex, concave, rounded, substantially flat, recessed, parallel or substantially parallel to the longitudinal axis of the body, and disposed at an angle that is not parallel or substantially parallel to the longitudinal axis of the body; (iii) at least one of the first grip plate and the second grip plate includes at least one surface that is at least one of: curved, sloped, chamfered, convex, concave, rounded, substantially flat, recessed, parallel or substantially parallel to the longitudinal axis of the body, and disposed at an angle that is not parallel or substantially parallel to the longitudinal axis of the body; (iv) the first grip plate and the second grip plate each include a pad thereon, the pad operating to provide a comfortable and/or ergonomic surface for gripping at least the at least one grasping mechanism of the percussion instrument; (v) the first grip plate and the second grip plate each include gripping surfaces thereon, the gripping surface of the first grip plate being substantially parallel or parallel to the gripping surface of the second grip plate; and (vi) the pad of the first grip plate and the pad of the second grip plate each including gripping surfaces thereon, the gripping surface of the pad of the first grip plate being substantially parallel or parallel to the gripping surface of the pad of the second grip plate.

The first hole of the at least two holes and/or the second hole of the at least two holes may be sized and shaped to operate to at least one of: permit the at least one grasping mechanism to be positioned therein such that a zone of space of a predetermined size is located between the first hole of the at least two holes and/or the second hole of the at least two holes and the at least one grasping mechanism, thereby permitting the at least one grasping mechanism to move freely within the first hole of the at least two holes and/or the second hole of the at least two holes; permit the at least one grasping mechanism to be positioned therein such that a zone of space of a predetermined size is located between the first hole of the at least two holes and/or the second hole of the at least two holes and the at least one grasping mechanism, thereby permitting the at least one grasping mechanism to move freely in at least a direction that is substantially along the length of the first hole of the at least two holes and/or the second hole of the at least two holes within the first hole of the at least two holes and/or the second hole of the at least two holes; permit the at least one grasping mechanism to be positioned therein and to be spaced away therefrom such that the at least one grasping mechanism operates to make one or more audible noises when hitting against the first hole of the at least two holes and/or the second hole of the at least two holes, thereby permitting the at least one grasping mechanism to move freely within the first hole of the at least two holes and/or the second hole of the at least two holes permit the at least one grasping mechanism to be positioned therein and to be spaced away therefrom such that the at least one grasping mechanism operates to make one or more audible noises when hitting against the first hole of the at least two holes and/or the second hole of the at least two holes, thereby permitting the at least one grasping mechanism to move freely in at least a direction that is substantially along the length of the first hole of the at least two holes and/or the second hole of the at least two holes; and permit the at least one grasping mechanism to be positioned therein and to be in contact with at least a portion thereof.

One or more components of at least one of the at least one grasping mechanism and the body may be made of at least one of: wood, plastic, metal, rubber, hard rubber, polytetrafluoroethylene, carbon fiber, and fiber.

In one or more embodiments, at least one of the following may occur or be included: (i) the at least one shaft of the at least one grasping mechanism is substantially stationary or fixed in a predetermined position within the first hole of the at least two holes and/or the second hole of the at least two holes and at least one of the first grip plate and the second grip plate are connected to the at least one shaft such that the at least one of the first grip plate and the second grip plate at least one of spin, rotate, swivel and tilt on respective ends of the at least one grasping mechanism; (ii) the at least one shaft of the at least one grasping mechanism is substantially stationary or fixed in a predetermined position within the first hole of the at least two holes and/or the second hole of the at least two holes and at least one of the first grip plate and the second grip plate are connected to the at least one shaft such that the at least one of the first grip plate and the second grip plate at least one of spin, rotate, swivel and tilt on respective ends of the at least one grasping mechanism, wherein the connection between the at least one shaft and the at least one of the first grip plate and the second grip plate comprises at least one of: a screw, a nail, a ball-snap combination, a pin-bearing combination, and a pin-ball bearing combination; (iii) at least a portion of the at least one shaft of the at least one grasping mechanism is in contact with at least a portion of an inside wall of the first hole of the at least two holes and/or the second hole of the at least two holes such that the at least one shaft is substantially stationary or fixed in a predetermined position within the first hole of the at least two holes and/or the second hole of the at least two holes; (iv) at least one of the first grip plate and the second grip plate are connected to the at least one shaft such that the at least one of the first grip plate and the second grip plate at least one of spin, rotate, swivel and tilt on respective ends of the at least one grasping mechanism; and (v) the at least one shaft is integral with the body.

According to yet another aspect, a percussion instrument may include a body having a longitudinal axis extending from a butt end to a striking end thereof and at least two holes extending through the thickness of the body substantially along and/or through a respective axis that is different from the longitudinal axis and that is different from the axis of the other hole of the at least two holes; and at least one hinge having a first disc at a first end thereof and a second disc at a second end thereof, at least one shaft extending from the first disc through a first hole of the at least two holes in the body to the second disc, and a releasable connection between the first disc and the second disc such that the at least one hinge operates to be positioned in the first hole of the at least two holes and the first disc and the second disc operate to be disconnected from each other and/or connected/re-connected to each other such that the at least one hinge operates to be positioned in a second hole of the at least two holes and/or re-positioned in the first hole of the at least two holes.

In one or more embodiments, at least one of the following may occur or be included: (i) the first hole is sized and shaped such that the at least one hinge operates to permit a user of the percussion instrument to hold the body in, or to perform in, at least one of: the French grip style and the right handed, matched grip style; (ii) the second hole is sized and shaped such that the at least one hinge operates to permit the user of the percussion instrument to hold the body in, or to perform in, the traditional, left-hand drumming grip style; and (iii) the at least one hinge comprises a first hinge and a second hinge; the first hole being sized and shaped such that the first hinge of the at least one hinge operates to be disposed in the first hole and to permit a user of the percussion instrument to hold the body in, or to perform in, at least one of: the French grip style and the right handed, matched grip style; and the second hole being sized and shaped such that the second hinge of the at least one hinge operates to be disposed in the second hole and to permit the user of the percussion instrument to hold the body in, or to perform in, the traditional, left-hand drumming grip style, wherein the first and second hinges operate to permit the user to switch between the first and second hinges, thereby allowing the user to comfortably and/or conveniently perform all of the different drumming styles achievable when using the first hinge or the second hinge.

The first hole of the at least two holes extending through the thickness of the body may be disposed at least one of: at a right angle in relation to the longitudinal axis, at substantially a right angle in relation to the longitudinal axis, transversely to the longitudinal axis, substantially transversely to the longitudinal axis, at an angle that is about ninety degrees with respect to the body and at an angle that is ninety degrees with respect to the body. The second hole of the at least two holes extending through the thickness of the body may be disposed at least one of: at an angle different from the angle of the first hole, at an angle that is not a right angle in relation to the longitudinal axis, at an angle that is not substantially a right angle in relation to the longitudinal axis, not transversely to the longitudinal axis, not substantially transversely to the longitudinal axis, at an angle other than about ninety degrees with respect to the body and at an angle other than ninety degrees with respect to the body. The angle of the first hole of the at least two holes may be at least one of: positioned between about 80 degrees and about 100 degrees with respect to the first side, the second side or the longitudinal axis of the body; positioned at about 90 degrees with respect to the first side, the second side or the longitudinal axis of the body; positioned at substantially 90 degrees with respect to the first side, the second side or the longitudinal axis of the body and positioned at 90 degrees with respect to the first side, the second side or the longitudinal axis of the body. The angle of the second hole of the at least two holes may be at least one of: positioned between about 80 degrees and about 45 degrees with respect to the first side or the second side, positioned between about 80 degrees and about 40 degrees with respect to the first side or the second side, positioned between about 70 degrees and about 45 degrees with respect to the first side or the second side, positioned between about 60 degrees and about 45 degrees w with respect to the first side or the second side, positioned between about 50 degrees and about 45 degrees with respect to the first side or the second side, positioned at about 80 degrees with respect to the first side or the second side, positioned at about 75 degrees with respect to the first side or the second side, positioned at about 70 degrees with respect to the first side or the second side, positioned at about 65 degrees with respect to the first side or the second side, positioned at about 60 degrees with respect to with respect to the first side or the second side, positioned at about 55 degrees with respect to with respect to the first side or the second side, positioned at about 50 degrees with respect to the first side or the second side, positioned at about 45 degrees with respect to the first side or the second side, positioned at about 40 degrees with respect to the first side or the second side, positioned at about 35 degrees with respect to the first side or the second side, positioned at about 30 degrees with respect to the first side or the second side, positioned between about 105 degrees and about 110 degrees with respect to the first side or the second side, positioned between about 105 degrees and about 120 degrees with respect to the first side or the second side, positioned between about 105 degrees and about 130 degrees with respect to the first side or the second side, positioned between about 105 degrees and about 140 degrees with respect to the first side or the second side, positioned between about 105 degrees and about 150 degrees with respect to the first side or the second side, positioned between about 105 degrees and about 160 degrees with respect to the first side or the second side, positioned between about 105 degrees and about 170 degrees with respect to the first side or the second side, positioned at about 105 degrees with respect to the first side or the second side, positioned at about 110 degrees with respect to the first side or the second side, positioned at about 115 degrees with respect to the first side or the second side, positioned at about 120 degrees with respect to the first side or the second side, positioned at about 125 degrees with respect to the first side or the second side, positioned at about 130 degrees with respect to the first side or the second side, positioned at about 135 degrees with respect to the first side or the second side, positioned at about 140 degrees with respect to the first side or the second side, positioned at about 145 degrees with respect to the first side or the second side, positioned at about 150 degrees with respect to the first side or the second side, positioned at about 155 degrees with respect to the first side or the second side, positioned at about 160 degrees with respect to the first side or the second side, positioned at about 165 degrees with respect to the first side or the second side, positioned at about 170 degrees with respect to the first side or the second side, and positioned at about 175 degrees with respect to the first side or the second side.

The body may include at least a first side extending between the butt end and the striking end of the body and at least a second side extending between the butt end and the striking end of the body.

The releasable connection may include at least one of: a screw; a threaded connection; a snap or press fit connection and a friction fit connection.

In one or more embodiments, at least one of the following may occur or be included: (i) the first hole of the at least two holes includes at least one recess or bore disposed or located substantially at an end of the first hole, the at least one recess or bore being sized and/or shaped to receive at least a portion of at least one of the first disc and the second disc therein such that the at least one recess or bore operates to permit the first disc and/or the second disc to be positioned at least one of: (a) closer to each other than when not having the at least one recess or bore; and (b) closer to the surface of the body of the percussion instrument; (ii) the second hole of the at least two holes includes at least one recess or bore disposed or located substantially at an end of the first hole, the at least one recess or bore being sized and/or shaped to receive at least a portion of at least one of the first disc and the second disc therein such that the at least one recess or bore operates to permit the first disc and/or the second disc to be positioned at least one of: (a) closer to each other than when not having the at least one recess or bore; and (b) closer to the surface of the body of the percussion instrument; (iii) the first hole of the at least two holes includes at least one of: (a) a first recess or bore of the at least one recess or bore at a first end of the first hole operating to permit at least a portion of the first disc to be disposed therein; and (b) a second recess or bore of the at least one recess or bore at a second end of the first hole operating to permit at least a portion of the second disc to be disposed therein; and (iv) the second hole of the at least two holes includes at least one of: (a) a first recess or bore of the at least one recess or bore at a first end of the first hole operating to permit at least a portion of the first disc to be disposed therein; and (b) a second recess or bore of the at least one recess or bore at a second end of the first hole operating to permit at least a portion of the second disc to be disposed therein.

In one or more embodiments, at least one of the following may occur or be included: (i) at least one of the first disc and the second disc includes a pad thereon, the pad operating to provide a comfortable and/or ergonomic surface for gripping at least the at least one hinge of the percussion instrument; (ii) the pad includes at least one surface that is at least one of: curved, sloped, chamfered, convex, concave, rounded, substantially flat, recessed, parallel or substantially parallel to the longitudinal axis of the body, and disposed at an angle that is not parallel or substantially parallel to the longitudinal axis of the body; (iii) at least one of the first disc and the second disc includes at least one surface that is at least one of: curved, sloped, chamfered, convex, concave, rounded, substantially flat, recessed, parallel or substantially parallel to the longitudinal axis of the body, and disposed at an angle that is not parallel or substantially parallel to the longitudinal axis of the body; (iv) the first disc and the second disc each include a pad thereon, the pad operating to provide a comfortable and/or ergonomic surface for gripping at least the at least one hinge of the percussion instrument; (v) the first disc and the second disc each include gripping surfaces thereon, the gripping surface of the first disc being substantially parallel or parallel to the gripping surface of the second disc; and (vi) the pad of the first disc and the pad of the second disc each including gripping surfaces thereon, the gripping surface of the pad of the first disc being substantially parallel or parallel to the gripping surface of the pad of the second disc.

The first hole of the at least two holes and/or the second hole of the at least two holes may be sized and shaped to operate to at least one of: permit the at least one hinge to be positioned therein such that a zone of space of a predetermined size is located between the first hole of the at least two holes and/or the second hole of the at least two holes and the at least one hinge, thereby permitting the at least one hinge to move freely within the first hole of the at least two holes and/or the second hole of the at least two holes; permit the at least one hinge to be positioned therein such that a zone of space of a predetermined size is located between the first hole of the at least two holes and/or the second hole of the at least two holes and the at least one hinge, thereby permitting the at least one hinge to move freely in at least a direction that is substantially along the length of the first hole of the at least two holes and/or the second hole of the at least two holes within the first hole of the at least two holes and/or the second hole of the at least two holes; permit the at least one hinge to be positioned therein and to be spaced away therefrom such that the at least one hinge operates to make one or more audible noises when hitting against the first hole of the at least two holes and/or the second hole of the at least two holes, thereby permitting the at least one hinge to move freely within the first hole of the at least two holes and/or the second hole of the at least two holes; permit the at least one hinge to be positioned therein and to be spaced away therefrom such that the at least one hinge operates to make one or more audible noises when hitting against the first hole of the at least two holes and/or the second hole of the at least two holes, thereby permitting the at least one hinge to move freely in at least a direction that is substantially along the length of the first hole of the at least two holes and/or the second hole of the at least two holes within the first hole of the at least two holes and/or the second hole of the at least two holes; and permit the at least one hinge to be positioned therein and to be in contact with at least a portion thereof.

One or more components of at least one of the at least one hinge and the body may be made of at least one of: wood, plastic, metal, rubber, hard rubber, polytetrafluoroethylene, carbon fiber, and fiber.

In one or more embodiments, at least one of the following may occur or be included: (i) the at least one shaft of the at least one hinge is substantially stationary or fixed in a predetermined position within the first hole of the at least two holes and/or the second hole of the at least two holes and at least one of the first disc and the second disc are connected to the at least one shaft such that the at least one of the first disc and the second disc at least one of spin, rotate, swivel and tilt on respective ends of the at least one hinge; (ii) the at least one shaft of the at least one hinge is substantially stationary or fixed in a predetermined position within the first hole of the at least two holes and/or the second hole of the at least two holes and at least one of the first disc and the second disc are connected to the at least one shaft such that the at least one of the first disc and the second disc at least one of spin, rotate, swivel and tilt on respective ends of the at least one hinge, wherein the connection between the at least one shaft and the at least one of the first disc and the second disc comprises at least one of: a screw, a nail, a ball-snap combination, a pin-bearing combination, and a pin-ball bearing combination; (iii) at least a portion of the at least one shaft of the at least one hinge is in contact with at least a portion of an inside wall of the first hole of the at least two holes and/or the second hole of the at least two holes such that the at least one shaft is substantially stationary or fixed in a predetermined position within the first hole of the at least two holes and/or the second hole of the at least two holes; (iv) at least one of the first disc and the second disc are connected to the at least one shaft such that the at least one of the first disc and the second disc at least one of spin, rotate, swivel and tilt on respective ends of the at least one hinge; and (v) the at least one shaft is integral with the body.

According to yet another aspect, a percussion instrument may include a body having a longitudinal axis extending from a butt end to a striking end thereof and at least one hole extending through the thickness of the body substantially along and/or through an axis that is different from the longitudinal axis; and a grasping mechanism having a first grip plate at a first end thereof and a second grip plate at a second end thereof, and a fastener extending from the first grip plate through the hole in the body to the second grip plate, wherein at least one of: (i) the fastener includes a first shaft connected to the first grip plate, a second shaft connected to the second grip plate, and a compliance mechanism located between the first and second shafts, the compliance mechanism operating to enable the first and second grip plates to be moved closer together in response to a compressive force applied to the at least one grasping mechanism; and (ii) the fastener comprises a compliance mechanism disposed between the first and second grip plates, the compliance mechanism operating to enable the first and second grip plates to be moved closer together in response to a compressive force applied to the at least one grasping mechanism.

In one or more embodiments, at least one of the following may occur or be included: (i) the axis of the hole and the longitudinal axis of the body at least one of: extend in different directions, are not parallel and are not co-linear; and (ii) the axis of the hole extends at least one of: across the longitudinal axis of the body; is transverse or substantially transverse to the longitudinal axis of the body; is perpendicular or substantially perpendicular to the longitudinal axis of the body; through the body and crosses over the longitudinal axis of the body; and along an axis that extends through, and crosses over from one side of the body to another side of the body.

The percussion instrument may further include first and second frictional contact devices, wherein at least one of: (i) the first frictional contact device comprises a first O-ring and the second frictional contact device comprises a second O-ring; (ii) the first and second frictional contact devices are located between an outside surface of the body and the inside surfaces of the first and second grip plates, respectively; (iii) the first and second frictional contact devices are located between the body and the first and second grip plates, respectively; (iv) the first and second frictional contact devices comprise an inside surface or portion of the first grip plate and an inside surface or portion of the second grip plate, respectively; (v) the first and second grip plates each include a groove disposed on, and in communication with, the inside surfaces of the first and second grip plates, the groove of the first grip plate operating to house the respective first frictional contact device therein and the groove of the second grip plate operating to house the respective second frictional contact device therein; and (vi) the first and second frictional contact devices operate to provide a braking function for slowing and/or stopping the relative motion between the body and the first and second grip plates and/or the grasping mechanism when at least one of the first frictional contact device and the second frictional contact device is brought into contact with the body of drumstick.

Other aspects, features, advantages, etc. will become apparent to one skilled in the art when the description of the preferred embodiments of the invention herein is taken in conjunction with the accompanying drawings.

BRIEF DESCRIPTION OF THE DRAWINGS

For the purposes of illustrating the various aspects of the invention, wherein like numerals indicate like elements, there are shown in the drawings simplified forms that may be employed, it being understood, however, that the invention is not limited by or to the precise arrangements and instrumentalities shown. To assist those of ordinary skill in the relevant art in making and using the subject matter hereof, reference is made to the appended drawings and figures, wherein.

DETAILED DESCRIPTION OF THE PREFERRED EMBODIMENTS

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention. Furthermore, reference in the specification to phrases such as "one embodiment" or "an embodiment" means that a particular feature, structure or characteristic described in connection with the embodiment is included in at least one embodiment of the invention. The appearances of phrases such as "in one embodiment" or "in an embodiment" in various places in the specification do not necessarily all refer to the same embodiment.

Figure 1:
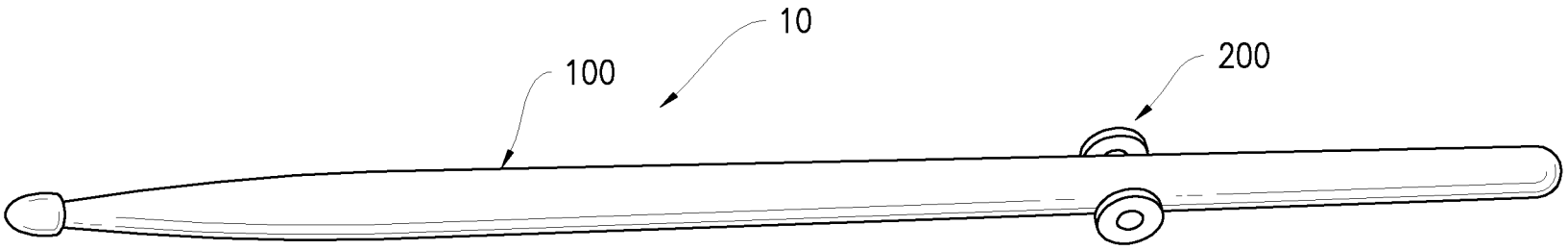
FIG. 1 is a perspective view of a drumstick in accordance with an embodiment of the present invention.

FIG. 1 is a perspective view of a drumstick 10 in accordance with an embodiment of the present invention. The drumstick 10 of FIG. 1 may include body 100 and hinge 200. These features will be discussed in greater detail in connection with FIG. 2.

Figure 2:
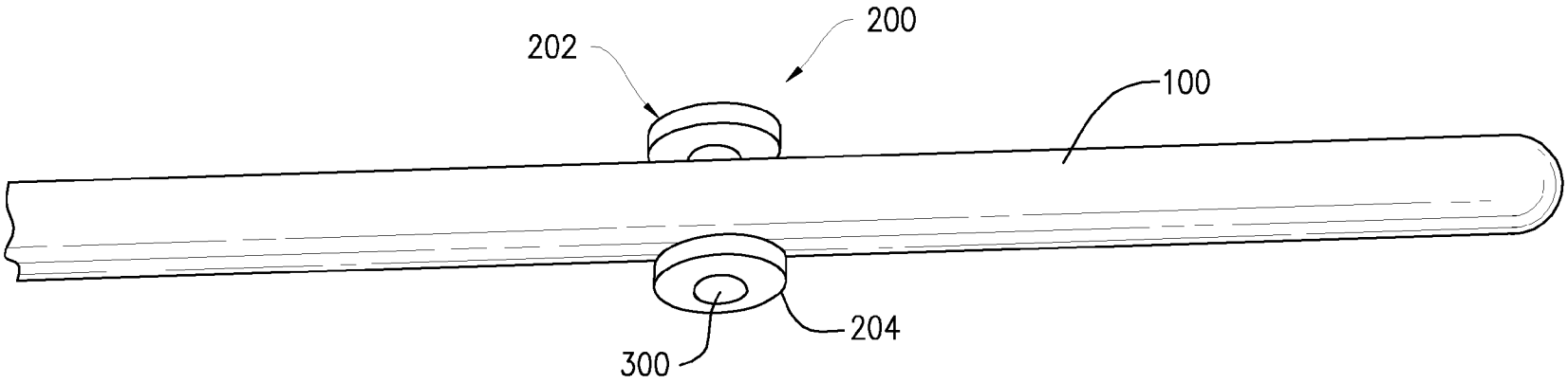
FIG. 2 is a perspective view of a portion of a drumstick in accordance with an embodiment of the present invention.

FIG. 2 shows body 100 and hinge 200 which may include hinge elements 202 and 204, and fastener 300. Fastener 300 may simply be a pin that is attachable to the hinge elements 202 and 204. Alternatively, fastener 300 may have a more complex geometry and a plurality of parts as discussed later herein.

Figure 3:
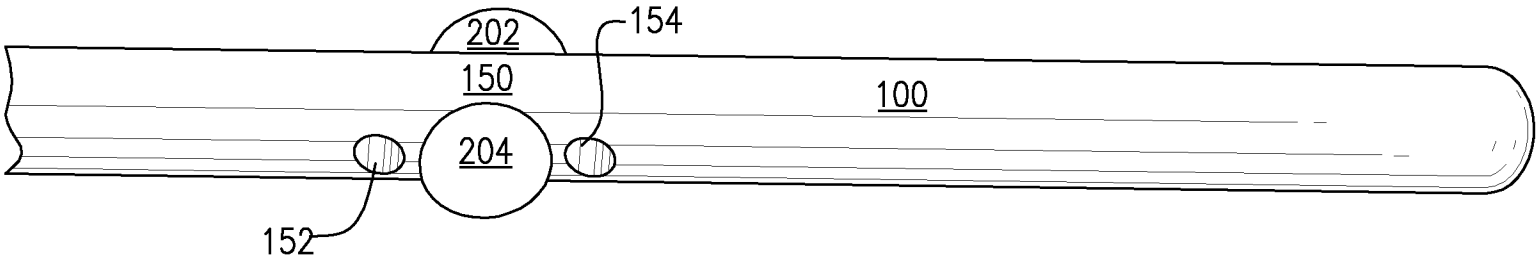
FIG. 3 is a perspective view of a portion of a drumstick in accordance with another embodiment of the present invention.

FIG. 3 is a perspective view of a portion of body 100 of drumstick 10. Body 100 may include holes 150, 152, and 154 and may be coupled to hinge elements 202 and 204. The location of hole 150 can only be shown indirectly as the nearest opening of hole 150 (in the view of FIG. 3) is obscured by hinge element 204. The distribution of holes 150, 152, and 154 preferably enables a user of drumstick 10 to select the most desirable pivot point along the length of body 100 at which to install hinge elements 202 and 204 forming fastener 300. Preferably, hinge elements 202 and 204 may be readily disconnected from one another, for example by unscrewing a threaded connection, and re-connected within a preferred hole among holes 150, 152, and 154.

Figure 4:
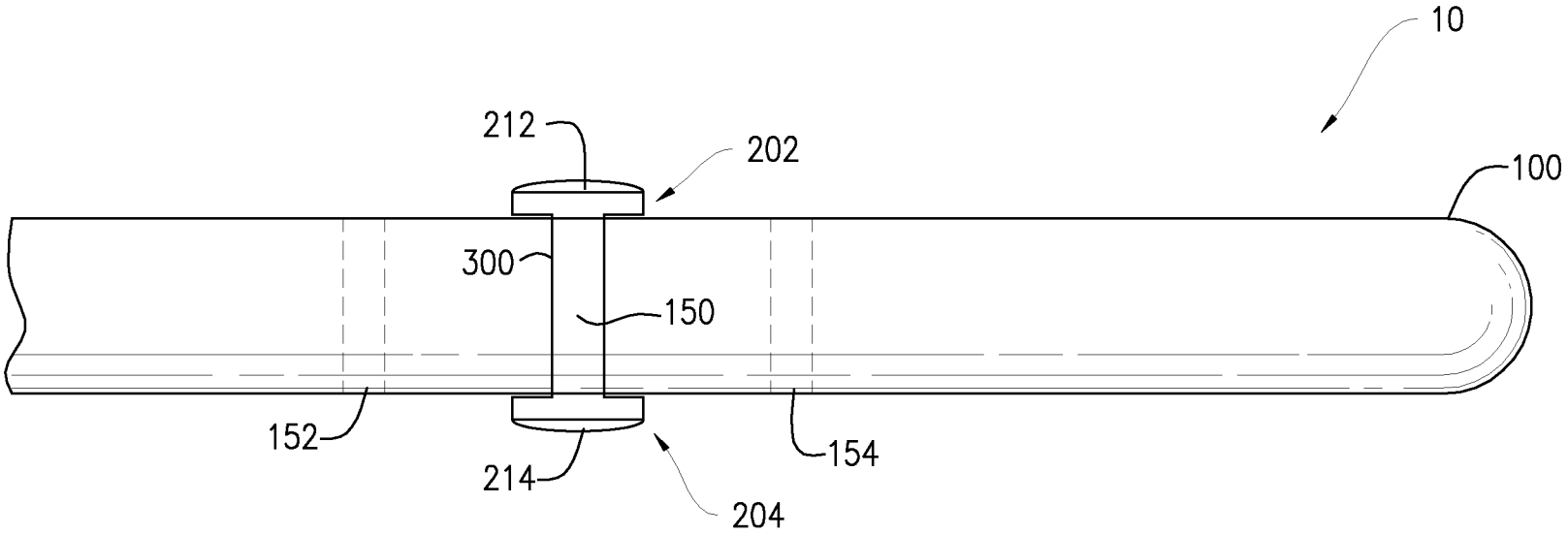
FIG. 4 is a sectional view of a drumstick in accordance of an embodiment of the present invention.

FIG. 4 is a sectional view of drumstick 10 in accordance of an embodiment of the present invention. FIG. 4 shows body 100 having holes 150, 152, and 154; fastener 300 inserted through hole 150; and hinge elements 202 and 204 having pads 212 and 214, respectively. Pads may be attached to their respective hinge elements to provide more desirable contact characteristics for a user of the drumstick 10. Alternatively, grip pads 212, 214 may be omitted, and each hinge element 202, 204 could be formed using a single integral part.

Figure 5:
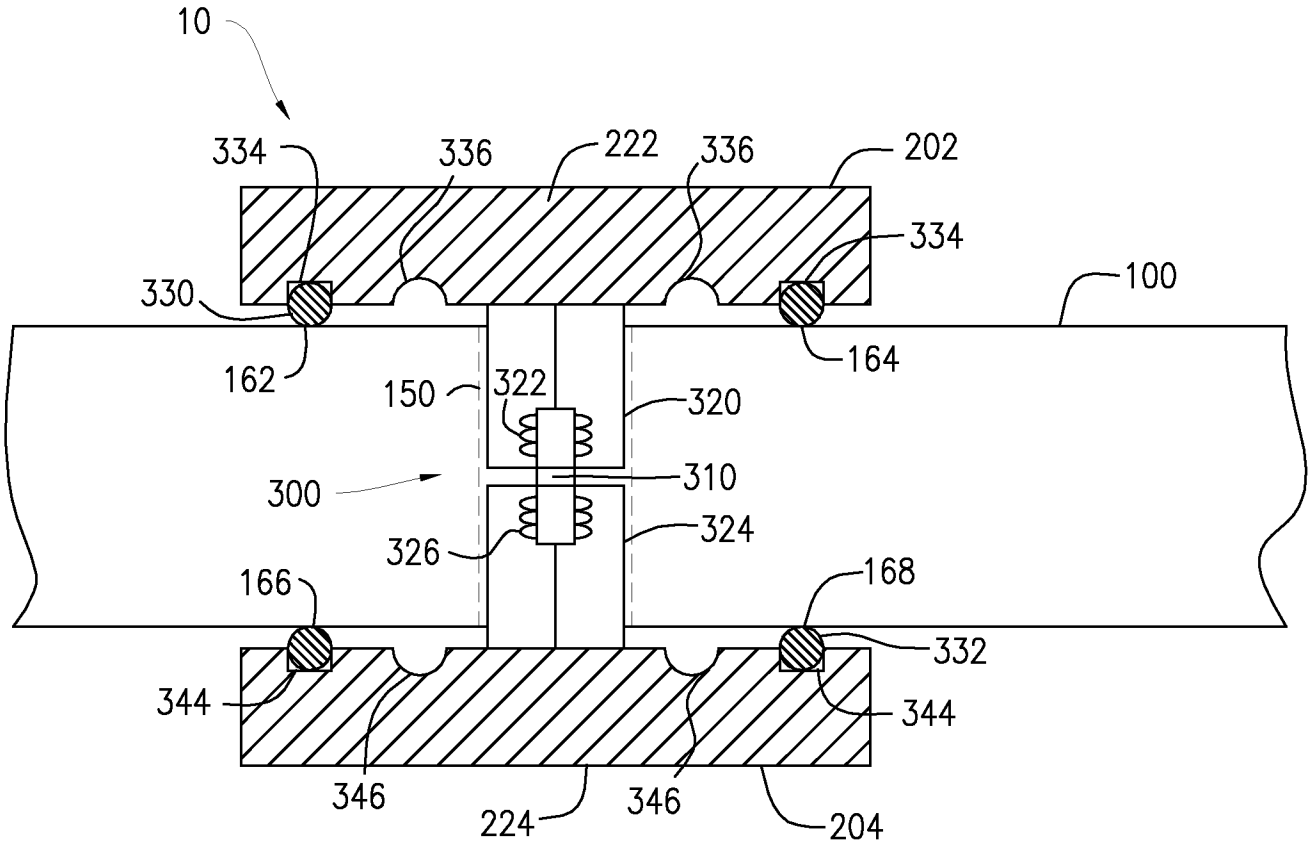
FIG. 5 is a more detailed sectional view of the drumstick of FIG. 4 in accordance with an embodiment of the present invention.

In this embodiment, hinge elements 202 and 204 may be readily disconnected from one another and then re-attached within a different one of three available holes 150, 152, 154. This disconnection and reconnection of hinge elements 202 and 204 may be achieved by unscrewing one of the threaded connections securing hinge elements 202, 204 together (see FIG. 5), and then re-connecting the two parts together in a different hole, selected from holes 150, 152, and 154. While a threaded connection is shown in FIG. 5, the present invention is not limited to this connection means. Other means of connecting two rods together may be practiced, such as a press fit, friction fit, etc. Moreover, while three holes are shown in FIGS. 3-4, it will be appreciated that in alternative embodiments, body 100 may include fewer or more than three holes.

FIG. 5 is a more detailed schematic sectional view of the percussion instrument 10 of FIG. 4 in accordance with an embodiment of the present invention. Percussion instrument 10 is preferably a drumstick but is not limited to this embodiment. Percussion instrument 10 may be any one of a number of other possible percussion instruments, including for instance, a Timpani stick.

Drumstick 10 of FIG. 5 may include body 100 and hinge 200. Hinge 200 may include hinge elements 202 and 204, set screw 310, and/or O-rings 330 and 332. Body 100 may be a conventional drumstick body that is preferably made of wood, though other materials may be employed. Body 100 may include flat portions 162, 162, 166, and 168 that are machined on a portion of body 100 that contacts O-rings 330 and 332 to maximize the surface area of contact between body 100 and the O-rings 330 and 332.

Hinge element 202 may include disk portion 222, shaft 320, open radius area (deflection recess) 336 for flexing hinge element 202 upon the application of force thereto, and groove 334 for housing O-ring 330. Similarly, hinge element 204 may include disk portion 224, shaft 326, deflection recess 346, and groove 344 for housing O-ring 332.

Fastener 300 may include shafts 320 and 324 of hinge elements 202 and 204 respectively. Fastener 300 may further include set screw 310 that may be disposed between shafts 320 and 324. Shafts 320 and 324 may include threaded regions 322 and 326, respectively, for engaging suitable portions of set screw 310. In other embodiments, shafts 320 and 324 may be configured to be capable of being directly screwed together without any need for an intervening set screw. Moreover, other mechanical attachment means may be provided for coupling shaft 320 of hinge element 202 and shaft 324 of hinge element 204.

Herein, the term "grasping mechanism" may refer to one or more parts included within hinge 200. The disk portions 222, 224 of hinge elements 202 and 204, respectively, may be referred to herein as grip plates. It will be appreciated that grip plates 222, 224 may, but need not be, disk shaped.

Hinge elements 202, 204 may be made of any desired material such as but not limited to wood, plastic, metal, polytetrafluoroethylene, or any combination of the foregoing. Shafts 320 324 may be made of the same materials as disk portions 222 and 224, or alternatively may be made of metal to strengthen the threaded connection with set screw 310. Set screw 310 is preferably made of metal, such as steel or aluminum. Alternatively, set screw 310 could be made of any other desirable material such as any of various plastics. O-rings 332 and 334 are preferably made of a suitably selected rubber. However, other materials may be used for O-rings 332, 334 if desired, such as, but not limited to plastic. Disk portions 222, 224 may be made of plastic, metal, or any other suitable material. While illustrated as disk-shaped, disk portions 222, 224 are not limited to having a disk-shaped geometry.

O-rings 330, 332 are disclosed herein as a mechanism for providing a "braking" function for the relative motion between body 100 and hinge elements 202 and 204. However, the present invention is not limited to the use of O-rings for this purpose, and other braking materials, which may be compressible materials, may be employed. Braking materials however are not limited to being compressible materials. Any material suitable for creating effective braking friction when brought into contact with the body 100 of drumstick 10 may be employed including but not limited to rubber, leather, one or more plastics of various types, wood, and/or metal. In other alternative embodiments, a combination of one or more of the foregoing materials may be employed.

In this section, the attachment means among the various parts are discussed. The disk portion 222 and shaft portion 320 of hinge element 202 may be two separate parts that are joined together. Alternatively, they form a single integral part. In one embodiment, portions 202 and 320 of hinge element 202 may be rotationally fixed with respect to one another. In other embodiments, shaft 320 may be capable of rotating freely with respect to disk portion 222. Arrangements analogous to the above may be applied to the connection between disk portion 224 and shaft portion 324 of hinge element 204.

Hinge elements 202 and 204 may be joined together by first attaching set screw 310 to the threaded portion 322 of shaft 320 of hinge element 202, and inserting the shaft portion 320 of hinge element 202 into hole 150 within body 100. Thereafter, the threaded portion 326 of shaft 324 of hinge element 324 may be threaded onto the free end of set screw 310. Once attached onto their respective ends of set screw 310, hinge elements 202 and 204 may be turned with respect to one another to secure a final attachment between the two parts. In another approach, the above process may be repeated in reverse, with the set screw 310 being first attached to hinge element 204, and hinge element 202 being threaded onto the assembly of set screw 310 and hinge element 204 within the interior of hole 150 of body 100.

Having described the individual parts, the materials the parts may be made of, and the interconnections between the parts, it remains to describe the operation of a preferred embodiment of the drumstick 10 of FIG. 5. Once fully assembled, and with no external force applied to force hinge elements 202 and 204 together, the body 100 of drumstick 10 is preferably pivotally mobile with respect to fastener 300 without any hindrance. A user may pick up drumstick 10 and hold it using disk portions (grip plates) 222 and 224 of hinge elements 202 and 204, respectively.

The user preferably initially holds the grip plates 222, 224 so as to apply force substantially at the center of the grip plates 222, 224 and thereby avoid deflecting the periphery of plates 222, 224 toward the o-rings 330, 332. In this manner, using the initial grasping position, body 100 is preferably freely pivotally mobile with respect to fastener 300, thereby enabling the desirable free rotational motion of body 100 for both learning and performing purposes.

Another benefit of using O-rings 330 and 332 is to prevent an undesirable clicking sound upon the impact of the striking end of drumstick 10, or other type of percussion instrument, with a drum skin, or other percussion surface. The possibility of a clicking sound upon impact of the drumstick with a drum skin arises from the presence of the apparatus of hinge 200 within and near body 100. An impact between body 100 and any portion of hinge 200 may produce the undesired clicking sound. The placement of O-rings 330 and 332 in the locations shown in FIG. 5 preferably operates to massively reduce and/or eliminate the undesired clicking sound by cushioning any undesired impact between hinge elements 202, 204 and body 100. It is noted that devices other than O-rings 330 and 332 may be employed to prevent the undesired impact between parts of hinge 200 and body 100.

When a user of drumstick 10 wishes to limit the rotational speed and/or the angular displacement of body 100 with respect to fastener 300, the user may shift the location of the compressive holding force on grip plates 222, 224 so as to deflect the edges of grip plates 222 and 224 about deflection recesses 334 and 344 respectively, and in turn cause O-rings 330 and 332 to impinge on body 100 of drumstick 10, which thereby operates to hinder the rotational motion of body 100 with respect to fastener 300. In this manner, the rotational speed and/or the angular motion range of body 100 with respect to fastener 300 may be controlled as a function of the location and magnitude of the compressive force applied by the user to the respective grip plates 222, 224. Moreover, the extent and location of the applied force is under the control of the user of drumstick 10, thereby enabling the user to either allow unimpeded pivotal motion of drumstick 10 or to controllably dampen the motion of drumstick 10 in response to the compressive force applied by the user.

Figure 6:
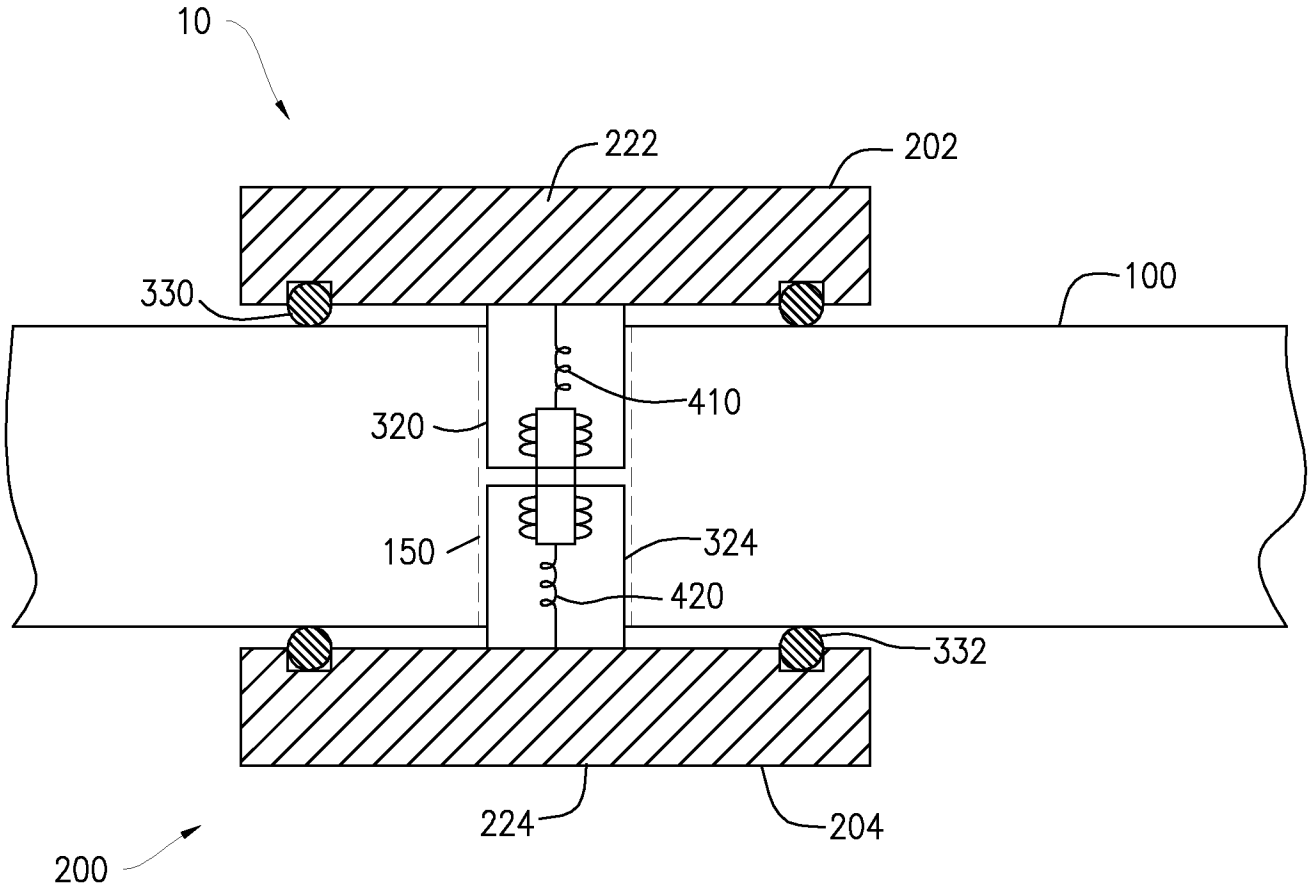
FIG. 6 is a schematic sectional view of a hinge coupled to a body of a drumstick in accordance with an embodiment of the present invention.

Another approach to enabling braking of the motion of body 100 with respect to hinge elements 202 and 204 is shown in FIG. 6. More specifically, an alternative approach to enabling the lateral (i.e. transverse-axis) compliance of hinge 200 in response to a compressive force so that O-rings 330 and 332 and can be moved toward body 100 to provide the desired braking function for the motion of body 100 with respect to hinge elements 202 and 204. Herein, the term "compliance device" may refer to the one or more springs 410, 420 of FIG. 6, or any other mechanism that is operable to enable disk portions 222 and 224 to move closer together in response to a compressive force applied thereto.

Accordingly, in FIG. 6, the deflection recesses 336, 346 may be omitted as shown. Instead, springs 410 and/or 420 may be employed to enable spring-loaded transverse-axis relative movement between disk portion 402 and disk portion 404. We turn now to the operation of the drumstick 10 of FIG. 6. When free motion of body 100 with respect to hinge 200 (including disk portions 202, 204) is desired, a user preferably holds disk portions 222, 224 with a compressive force sufficiently small so that O-rings 330, 332 do not impart any significant frictional braking force against body 100 of drumstick 10. When a user wishes to control the pivotal speed and/or extent of pivotal motion of body 100 with respect to disk portions 222, 224, the user may hold disk portions 222 and 224 with a compressive force sufficient to move these two parts towards one another and thereby bring O-rings 330, 332 into contact with body 100, thereby imparting a frictional braking force to body 100. Thereafter, the braking effect may be adjusted by the user by adjusting the amount of compressive force used to hold disk portions 222 and 224. If desired, the compliance features of FIG. 5 and FIG. 6 could be combined within a single embodiment. Thus, one or both of springs 410, 420 could be included along with one or more of deflection recesses 336, 346.

While the above embodiments involve using O-rings 330, 332 as the entity making frictional contact with body 100, i.e. as the "braking material," the present invention is not limited to the use of O-rings. Other materials having other shapes may be employed either in addition to, or in place of, O-rings 330, 332. Other materials for the frictional contact device (i.e. the role of O-rings 330, 332 in FIG. 6) may include but are not limited to plastic, rubber, wood, fiberglass, metal, or any combination of the foregoing. In still other embodiments, the presence of a braking material separate from disk portions 222 and 224 could be omitted entirely. Where such separate braking material is omitted, friction between the internal surfaces of disk portions 202, 204 themselves and the body 100 could be used to brake and/or control the motion of body 100 with respect to the disk portions 222 and 224.

While two springs 410, 420 are shown in FIG. 6, it will be appreciated that three or more springs could be employed. Moreover, the invention may be practiced using only a single spring. Moreover, the one or more springs providing the needed compliance need not be located as springs 410 and 420 are shown in FIG. 6. Compliant devices, such as springs, could be located at any point that would allow disk portions 222 and 224 move closer together upon the application of compressive force between these two parts.

In one embodiment, a detent mechanism (not shown) could be employed along the structural path from disk portion 222 and 224 to establish a threshold force level below which disk portions 222 and 224 would not move closer together. At compressive force levels above the detent-mechanism compressive-force threshold, the compressive force would begin to force disk portions 222 and 224 together and initiate the braking function discussed above.

One or more embodiments of the present provide the benefits of enabling the player to visualize and feel the rebound; enabling the player to visualize and feel how a loose grip can benefit playing; enabling the player to work on velocity strokes, facilitating the whipping motion of the Moeller Technique; promoting finger technique for the Timpani technique; forcing the player to hold the stick in the correct manner by gripping the pads between the thumb and index finger; and/or allowing the player to have control of the stick by squeezing the pads for more technical playing such as for double strokes and buzz rolls.

In alternative embodiments, the following variations could be practiced to benefit various embodiments of the invention: (1) the use of different hole diameters; (2) the use of different hole locations; (3) the use of a different size or type of stick; (4) the use of a different drum stick tip (wood or nylon); (5) the use of a timpani stick; (6) a variation in the diameter of the portion of fastener 300 extending though hole 150; (7) the use of a different diameter (or shape) of the disk portions 222, 224 of the hinge elements 202, 204; and/or (8) the use of different means of securing together the shaft portions 320, 324 that engage one another within hole 150.

Figure 7A:
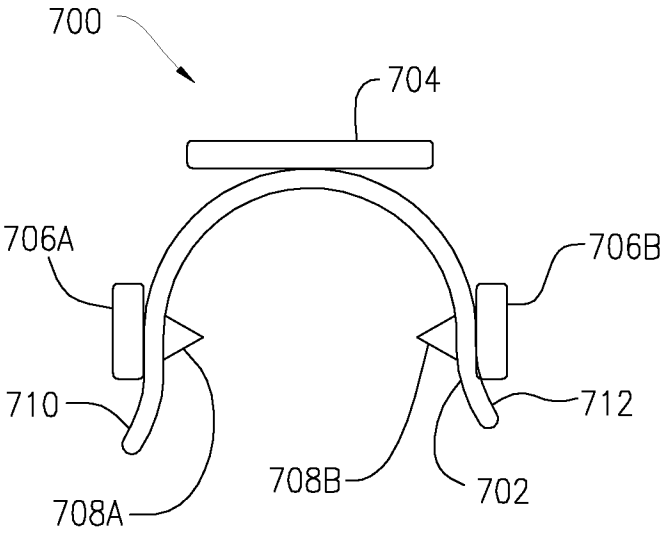
FIG. 7A is an elevational view of a hinge clip device suitable for attachment to a percussion instrument such as a drumstick in accordance with an embodiment of the present invention.
Figure 7B:
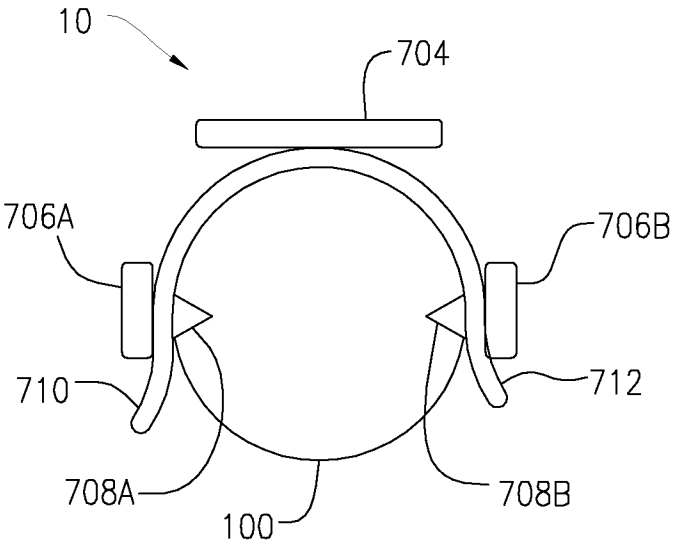
FIG. 7B is an elevational view of the hinge clip device of FIG. 7A attached to the body of a percussion instrument in accordance with an embodiment of the present invention.

FIG. 7A is an elevational view of a hinge clip device 700 suitable for attachment to a percussion instrument 10 such as a drumstick in accordance with an embodiment of the present invention. FIG. 7B is an elevational view of the hinge clip device 700 of FIG. 7A attached to the body of a percussion instrument 10 in accordance with an embodiment of the present invention.

Hinge clip device 700 may include handle 704, saddle 702, flaps 710, 712, pads 706A and 706B. Further, portions of saddle 702 inward of, and adjacent to, each of pads 706A and 706B preferably include pin-shaped protrusions 708A, 708B extending inwardly from flaps 710 and 712. The pin-shaped protrusions 708A, 708B are preferably located at corresponding positions on the inner surfaces of flaps 710 and 712, respectively, which protrusions combine to form an axis of rotation about which body 100 may rotate once a user applies compressive force to the outer surfaces of pads 706A and 706B. Saddle 702, which preferably includes flaps 710 and 712, is preferably a single, integral part. But, in alternative embodiments saddle 702 could be made from a plurality of parts that are appropriately joined together.

Saddle 702 is preferably a deformable member made of a material with an initial spring bias toward a position narrower than the diameter of body 100 to which it is intended to be attached, but with flap portions 710 and 712 capable of being forced apart to enable saddle 702 to be mounted onto a percussion-instrument body 100. Handle 704 may be attached (either removably or permanently) to saddle 702 using one or more of: glue, welding, screws, clips, clamps. Saddle 702 may be made of plastic, metal, fiberglass, or any other material capable of providing the needed spring action. Pads 706A and 706B may be made of any substantially solid material including but not limited to plastic, wood, and/or metal.

Protrusions 708A/708B may be made of metal, plastic, or other material suitable for creating a pivot point on body 100 when brought into contact with body 100. Protrusions 708A, 708B may have any shape suitable for engaging body 100 at a point, thereby allowing body 100 to pivot around this point. Protrusions 708A, 708B may be triangular-shaped as shown in FIGS. 7A and 7B. However, alternatively, protrusions 708A, 708B could have the shape of pins, or other shape suitable for engaging body 100 in a manner that allows body 100 to rotate with respect to saddle 702. Pads 706A/706B and protrusions 708A/708B may be affixed to flaps 710, 712 by any suitable means including but not limited to glue, welding, screws, clips, clamps, etc. Alternatively, pads 706A and 706B may be rotatably attached to saddle 702. In this alternative embodiment, body 100 and saddle 702 could rotate with respect to pads 706A and 706B, with the resulting rotation axis of the body 100 with respect to pads 706A/706B being determined by the rotation axis of each of pads 706A and 706B. In this alternative embodiment, protrusions 708A and 708B could be omitted.

Device 700 may be employed to provide a mechanism for grasping a percussion instrument such as a drumstick that enables the instrument to pivot freely about an axis defined by the location of the protrusions 708A/708B into body 100 from pads 706A and 706B. The benefits of such rotation of body 100 were discussed earlier in this disclosure and are therefore not repeated here. Moreover, the embodiment of FIG. 7 enables a user to readily attach clip device 700 onto a drumstick body 100 and remove it from body 100 at will, in contrast to other designs in which the handle assembly that allows rotational movement is essentially permanently installed to the body 100.

Saddle 702 is preferably springingly biased toward a position suitable for grasping the outer diameter of body 100, but compliant enough to allow flaps 710, 712 to be pushed apart as saddle 702 is pushed onto the outer diameter of body 100. Clip device 700 is shown alone, and without any force being imparted thereto in FIG. 7A. FIG. 7B shows clip device 700 mounted onto body 100 of percussion instrument 10. Once clip device 700 is mounted onto body 100, a user may hold instrument 10 using pads 706A and 706B and allow the body 100 to rotate about an axis defined the locations of protrusions 708A, 708B. However, in alternative embodiments, one or both of protrusions 708A, 708B may be omitted.

Figure 8A:
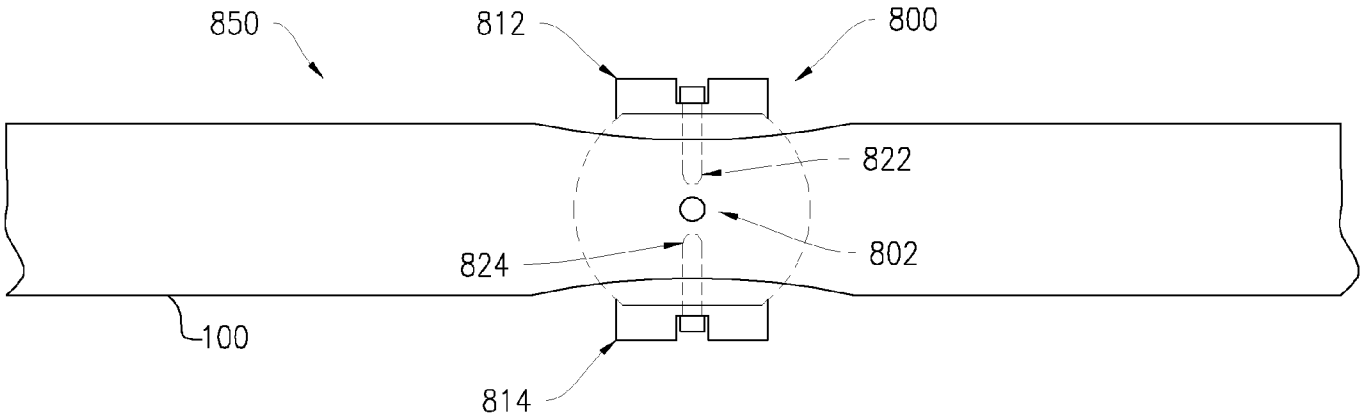
FIG. 8A is a partially sectional view and partially elevational view of a percussion instrument including a body and a wheel assembly.
Figure 8B:
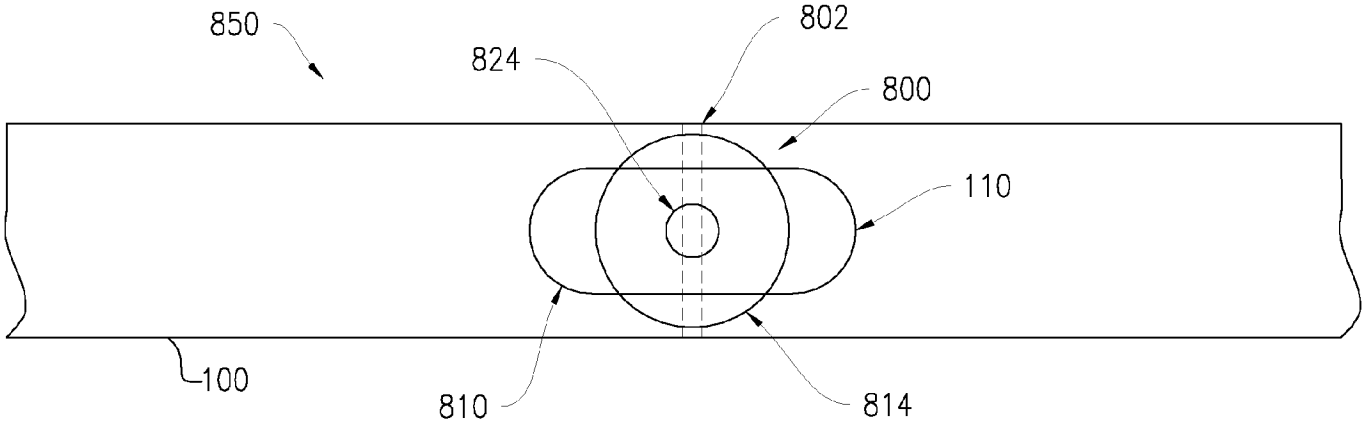
FIG. 8B is an alternate view of the percussion instrument of FIG. 8A.

FIG. 8A is a partially sectional view and partially elevational view of a percussion instrument 850 including a body 100 and a wheel assembly 800; and FIG. 8B is an alternate view of the percussion instrument of FIG. 8A.

Percussion instrument 850 provides a wheel assembly (also referred to herein as a "handle") 800 that provides a comfortable and convenient gripping surface for a user holding percussion instrument 850. In this embodiment, percussion instrument 850 includes wheel assembly 800 that rotates about the same or substantially the same axis as the percussion instrument 850 itself. This approach preferably provides a more comfortable grip on percussion instrument 850 by a user thereof.

Percussion instrument 850 may include body 100, which includes slot 110, and wheel assembly 800. Wheel assembly 800 may include pin 802, wheel (disk) 810, caps 812 and 814 (also referred to herein as "pads"), and screws 822 and 824 binding holding caps 812 and 814, respectively, to wheel 810. Disk 800 bears against, and rotates about, pin 802 and rotates within slot 110 in body 100. Pin 802, and therefore the axis of rotation of body 100, is preferably located closer to the butt end of body 100 than to the striking end thereof. As best shown in FIG. 8B, pin 802 preferably extends through a crosswise (i.e. a direction perpendicular to the longitudinal axis of body 100) hole within body 100.

Body 100 may be made of wood, plastic, or any other suitable material. Disk 800 may be made of plastic, wood, metal or any other suitable material. Caps 812, 814 may be made of metal, plastic, wood, or any other suitable material. Screws 822, 824 may be made of metal or plastic, or other suitable material.

In an embodiment, a user may use percussion instrument 850 for percussion purposes by grasping disk 810 by placing a thumb of one hand on cap 814 of wheel assembly 800 and one or more other fingers of the same hand on cap 812. Preferably, a user moves the entire percussion instrument 850 toward a percussion skin or other percussion surface while holding caps 812 and 814 of wheel 810. The motion of the longer portion of body 100, located between pin 802 and the striking end of body 100 (which may be toward the left, in the view of FIG. 8), around the axis of pin 802 moves the striking end (to the left in FIG. 8) of percussion instrument 850 toward a percussion surface for creating a percussion sound. As the longer portion of body 100 moves toward the percussion surface (not shown), the body 100 rotates (counterclockwise in the view of FIG. 8A) about to pin 802 and with respect to disk 800 which is preferably being held by the user.

As best shown in FIG. 8A, the flat portions of caps 812 and 814 may operate as limits on the angular range of rotation of body 100 with respect to wheel 810. However, in other embodiments, these limits may be altered as needed according to the requirements for a particular percussion instrument 850.

Figure 9:
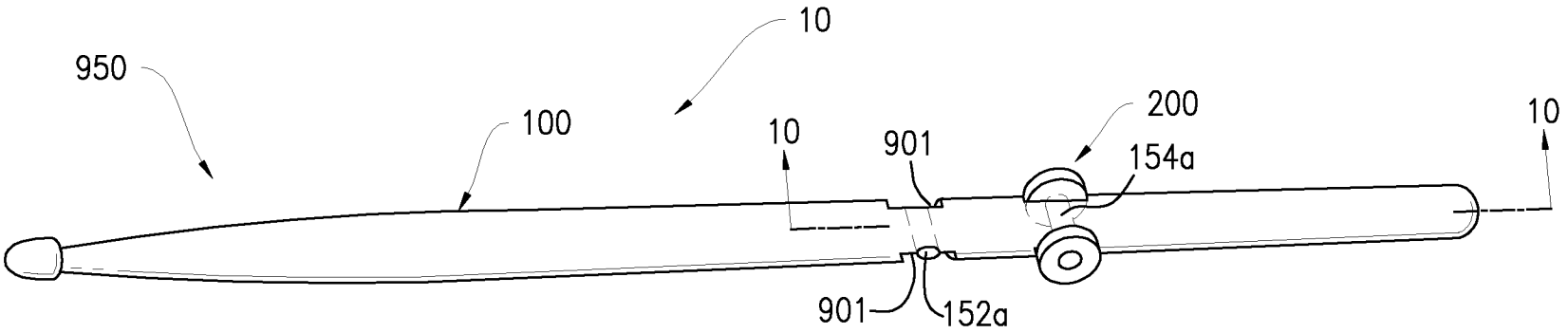
FIG. 9 is a perspective view of at least a further embodiment of a drumstick in accordance with one or more aspects of the present invention.
Figure 10:
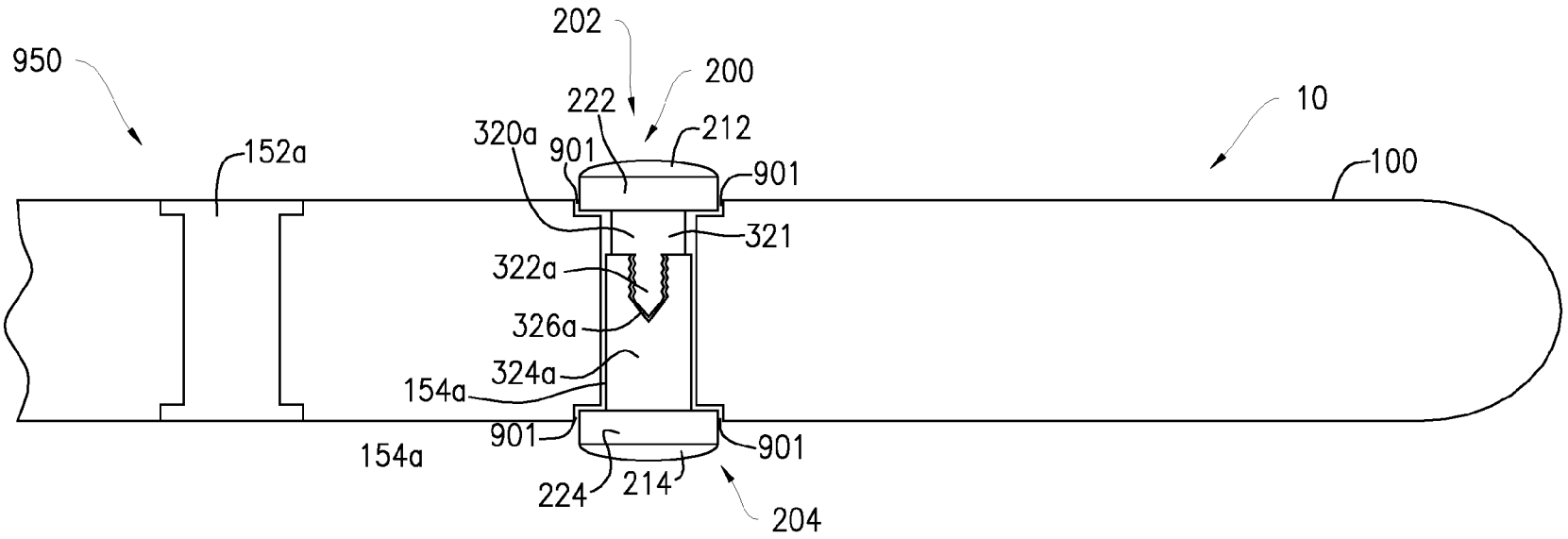
FIG. 10 is a cross-sectional view of at least a further embodiment of a drumstick taken along line 10-10 as shown in FIG. 9 in accordance with one or more aspects of the present invention.

As illustrated in FIGS. 9-10, at least a further embodiment of the present invention may comprise a percussion instrument 950, such as a drumstick 10 having a body 100 as discussed above. The body 100 may include at least two holes 152*a*, 154*a* (e.g., a third hole, such as hole 150 may not be included; alternatively, one or more of the holes 152*a*, 154*a* may be excluded in one or more embodiments or additional holes, such as hole 150, may be included in one or more further embodiments; alternatively, only one hole 150, 152*a*, 154*a* may be used.). The holes 152*a*, 154*a* may include a recessed counterbore/groove/cavity 901 (also may be referred to as a gauged out radius, depression, aperture, concave radius, spherical radius, recess, bore, groove, cavity, etc.) that operates to permit the one or more discs 222, 224 of hinge 200 and/or pads 212, 214 of discs 222, 224, respectively, to be disposed at least partially or completely therein such that the one or more discs 222, 224 and/or pads 212, 214 of the one or more discs 222, 224 may be positioned closer together (e.g., as compared with a stick that does not use such a recess or bore 901) and/or closer to the surface of the drumstick 10. Preferably, the one or more discs 222, 224 are partially in the recess 901 and partially overflow out of the recess 901. Preferably, one or more of the holes 152*a*, 154*a* each include two recessed counterbores/grooves/cavities 901 where the two recessed cavities 901 are disposed/located at, or are in communication with, each end of the holes 152*a*, 154*a* (best seen in FIG. 10). While the recesses 901 of the holes 152*a*, 154*a* are shown having edges positioned in relation to each other with substantially right angles, the geometry of the recesses 901 are not limited to this configuration and may comprise any shape (e.g., square, rectangular, circular, ovular, etc.) or size (e.g., one or more chamfered surfaces, one or more sloped surfaces, one or more rounded edges/surfaces, etc.) to accommodate a user's requirements for training, commercial expense considerations, different sizes and shapes of the discs 222, 224, ergonomic comfort of a user, etc. Preferably, each of the holes 152*a*, 154*a* has the same or substantially similar/same shape and size. Preferably, each of the holes 152*a*, 154*a* are sized and shaped to permit a hinge 200 (as discussed above and as discussed further below) to be positioned therein such that a zone of space of a predetermined size is located therebetween (e.g., the hinge 200 may be positioned in, and spaced away from, one of the holes 152*a*, 154*a* such that the hinge 200 is not in direct contact with a portion of an inside surface of the holes 152*a*, 154*a*, thereby permitting the hinge 200 to move freely within the holes 152*a*, 154*a*, or such that the hinge 200 is in contact with a portion of an inside surface of the holes 152*a*, 154*a*, thereby permitting the hinge 200 to move freely within the holes 152*a*, 154*a*, etc.). Indeed, such structure permits a user of the instrument 950 to listen for audio cues, such as clicking noises, to determine whether the user is drumming properly. Alternatively and preferably, a user of the instrument 950 may not need audio cues, such as clicking noises, to determine whether he/she is using the instrument 950 properly. Thus, the hinge 200 may move freely within the holes 152*a*, 154*a* without producing an audio cue or sound. Thus, in an alternative embodiment, the hinge 200 may be in contact with one or more inside portions of the holes 152*a*, 154*a*. By way of another example of the size and shape of the holes 152*a*, 154*a*, the grooves 901 may be sized and shaped as the grooves underneath pads 812, 814 as shown in FIG. 8A. Additionally, the hinge 200 as shown in FIGS. 9-10 may or may not include O-rings 330 and 332 as discussed above.

The percussion instrument 950 may include a hinge 200 where the disc 222 and/or the pad 212 thereof (e.g., of hinge element 202) may be connected to the disc 224 and/or the pad 214 thereof (e.g., of hinge element 204) via one or more shafts 320, 324 as discussed above. Preferably, the discs 222, 224 or a portion thereof includes a flat diameter (e.g., such as a portion of the discs 222, 224 coming out or overflowing out of the bore 901) to permit gripping the discs for easier connection or disconnection to each other (e.g., easier screwing, unscrewing, etc.) The discs 222, 224 and/or the pads 212, 214 of shafts 320*a*, 324*a* (as best seen in FIG. 10) may be connected (e.g., via clamping, tightening, snap-fitting, screwing, etc.) to each other, e.g., in similar fashion to the shafts 320, 324 of hinged elements 202, 204 as discussed above. Indeed, those skilled in the art will appreciate that the elements (e.g., the shafts 320*a*, 324*a*; threaded regions 322*a*, 326*a* of the shafts 320*a*, 324*a* as discussed further below; etc.) of the drumstick 10 may operate in similar fashion to those like-numbered elements (e.g., substantially same or similar numbers but with a letter such as 320 and 320*a*, 324 and 324*a*, 322 and 322*a*, 326 and 326*a*, etc.) as discussed above or any additional like-numbered elements discussed further herein below. For example, one or more alternative embodiments of a hinge 200 may be used (such as shown in FIGS. 11A-11E as discussed further below which may operate in a similar fashion as the hinges 200 discussed above) and may include components with alternative sizes and shape, such as, but not limited to, discs 224, 224*a*, 224*b*; pads 212, 212*a*, 214, 214*a*; threaded regions 322, 322*a*, 322*b*, 322*c*, 322*d*, 322*e*, 322*f*, 326, 326*a*, 326*b*, 326*c*, 326*d*, 326*e*, 326*f*; shafts 320, 320*a*, 320*b*, 320*c*, 320*d*, 320*e*, 320*f*, 324, 324*a*, 324*b*, 324*c*, 324*d*, 324*e*; 324*f*; etc. As discussed above, one or more components of the hinge 200, such as the hinge elements 202, 204 shafts 320*a*, 324*a*, etc., may be made of any desired material such as but not limited to wood, plastic, metal, rubber, hard rubber, polytetrafluoroethylene, carbon fiber, fiber, any combination of the foregoing, etc. One or more components of the hinge 200, such as the hinge elements 202, 204, the shafts 320*a*, 324*a*, etc., may be made of any desired material that permits the one or more components of the hinge 200 to act as a compliant material/compliance mechanism (e.g., as discussed above) that operates to permit the discs 222, 224, 224*a*, etc. to be brought closer together in response to a compressive force applied to the hinge 200. For example, one or more of the shafts 320*a*, 324*a* may include resilient or pliant material, such as rubber, that would permit the shafts 320*a*, 324*a* to compress in response to a force applied to the hinge 200, such as to the grip plates/discs 322, 324, 324*a*, etc.

Moreover, the shafts 320*a*, 324*a* (as best seen in FIG. 10) may be sized and shaped such that the shafts 320*a*, 324*a* and/or the hinge elements 202, 204 may be releasably connected, readily disconnected from one another and/or then releasably re-attached within a different available hole or re-positioned within the same hole, such as holes 152*a*, 154*a*. This disconnection and reconnection of hinge elements 202 and 204 and/or the shafts 320*a*, 324*a* may be achieved, for example, by unscrewing one of the threaded connections securing hinge elements 202, 204 together (see FIG. 10), and then re-connecting the two parts together in a different hole, selected from the other hole 152*a* or 154*a*. Preferably, the shaft 320*a* of the hinge element 202 and the shaft 324*a* of the hinge element 204 may be connected directly to each other, e.g., such that an intermediate component, such as the set screw 310 as discussed above, may not be included to complete the connection therebetween. Indeed, as discussed above for shafts 320, 324, shafts 320*a*, 324*a* may be configured to be capable of being directly screwed together without any need for an intervening set screw. For example, the shafts 320*a*, 324*a* may include threaded regions 322*a* and 326*a*, respectively, for engaging suitable portions of each other. Each of the threaded regions 322*a*, 326*a* may include a predetermined thread size (e.g., #10 thread hole, #10 thread, etc.). Moreover, other mechanical attachment means may be provided for coupling the shaft 320*a* of the hinge element 202 and the shaft 324*a* of the hinge element 204. In at least one embodiment (as shown in FIG. 10), the shaft 320*a* may include at least two portions 321 and 322*a* where the portion 321 may have a larger cross-section (such as a larger radius, larger diameter, etc.) than the cross-section of the threaded section 322*a* of the shaft 320*a*. Additionally or alternatively, the shaft 324*a* may have a larger cross-section (such as a larger radius, larger diameter, etc.) than the cross-section of the sections 321 and 322*a* of the shaft 320*a* for structural strength, alignment, to prevent buckling, etc. The shaft 324*a* may be longer than the shaft 320*a* as well. One or more alternative embodiments may include various other sizes and shapes for the shafts 320*a*, 324*a*; the threaded sections 322*a*, 326*a*; etc. as discussed further below with reference to FIGS. 11A-11E. The threaded regions 322*a*, 326*a* (e.g., as shown in FIG. 10) may be attached via the threaded connection in a predetermined location of the hole, such as substantially in the center of the hole 154*a*, such that the threaded regions 322*a*, 326*a* may be disposed substantially in between each end of the hole 154*a* (e.g. threaded regions 322*a*, 326*a* may be disposed substantially equidistantly from each end of the hole 154*a*; threaded region 322*a* may be located ¼ of the distance into the hole from the first end of the hole 154*a* while the threaded region 326*a* may be located ¾ of the distance into the hole 154*a* from the other end of the hole 154*a*; etc.).

In one or more embodiments, the shafts 320, 324, 320*a*, 324*a* as discussed above and/or shown in at least FIGS. 1-10, 11A and 11E (or other shafts discussed further below and/or shown in FIGS. 11A-11E, such as, but not limited to the shafts 320*b*, 320*c*, 320*d*, 320*e*, 320*f*, 324*b*, 324*c*, 324*d*, 324*e*, 324*f*, etc.) may be attached to the discs 222, 224, 224*a* and/or the pads 212, 212*a*, 214, 214*a* via a connection that permits the discs 222, 224, 224*a* and/or the pads 212, 212*a*, 214, 214*a* to at least one of spin, rotate, swivel, tilt, etc. on the shafts 320, 324, 320*a*, 324*a*. Such a connection may include, but is not limited to, a screw, a nail, a ball-snap connection, a pin bearing (such as a ball bearing) combination, etc. In one or more embodiments, one or more portions of the shafts 320, 324, 320*a*, 324*a* as discussed above (or other shafts discussed further below, such as, but not limited to the shafts 320*b*, 320*c*, 320*d*, 320*e*, 320*f*, 324*b*, 324*c*, 324*d*, 324*e*, 324*f*, etc.) may be in contact with at least a portion of the inside of the hole 150, 152, 154, 150*a*, 152*a*, 154*a* such that the shafts 320, 324, 320*a*, 324*a* as discussed above (or other shafts discussed further below, such as, but not limited to the shafts 320*b*, 320*c*, 320*d*, 320*e*, 320*f*, 324*b*, 324*c*, 324*d*, 324*e*, 324*f*, etc.) are substantially stationary or fixed in a predetermined position. Thus, the discs 222, 224, 224*a* and/or the pads 212, 212*a*, 214, 214*a* may spin, rotate, swivel, etc. while the shafts 320, 324, 320*a*, 324*a*, 320*b*, 320*c*, 320*d*, 320*e*, 320*f*, 324*b*, 324*c*, 324*d*, 324*e*, 324*f* remain substantially in its set position within one of the holes 150, 152, 154, 150*a*, 152*a*, 154*a*. Such structure may be employed with the recesses or bores 901 as discussed above. In one or more such embodiments, at least a portion of the discs 222, 224, 224*a* may at least one of: (i) spin, rotate, swivel or tilt inside the recesses or bores 901; and (ii) spin, rotate, swivel or tilt outside the recesses or bores 901. In at least a further embodiment, the shafts 320, 324, 320*a*, 324*a*, 320*b*, 320*c*, 320*d*, 320*e*, 320*f*, 324*b*, 324*c*, 324*d*, 324*e*, 324*f* may be integral with the body 100 of the drumstick 10.

Figure 11A:
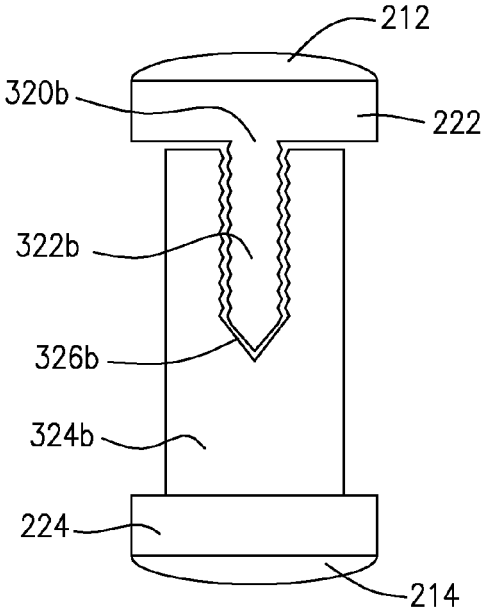
FIGS. 11A-11E are cross-sectional views of one or more further embodiments of a hinge in accordance with one or more aspects of the present invention.
Figure 11B:
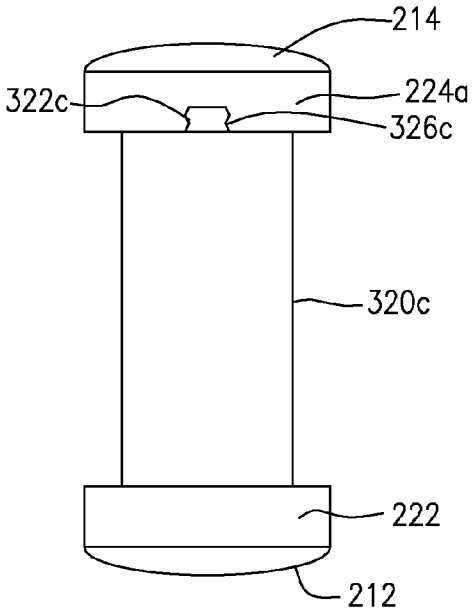
Figure 11C:
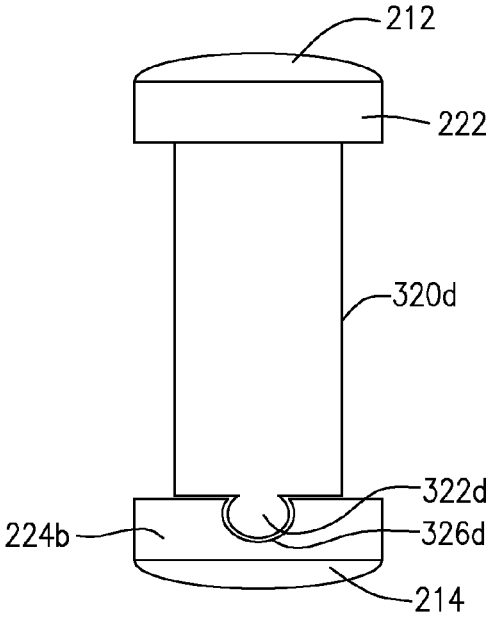
Figure 11D:
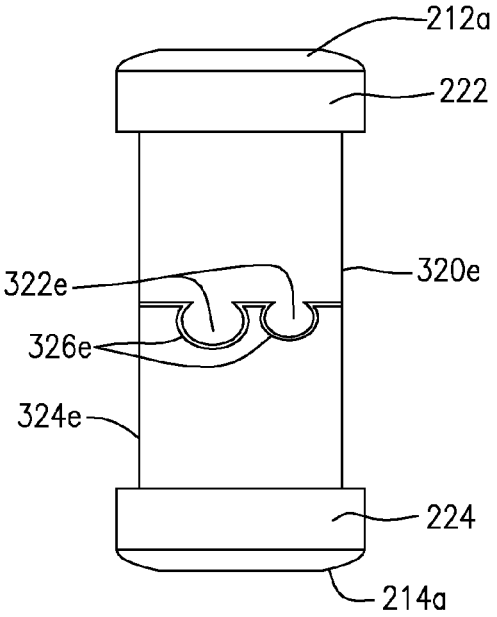
Figure 11E:
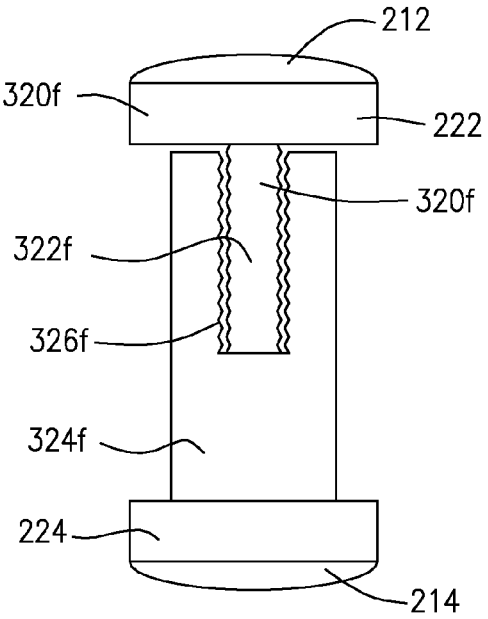

Additionally, various sizes and shapes may be used for the shafts 320*a*, 324*a*; the threaded sections 322*a*, 326*a*; the discs 222, 224, 224*a*; the pads 212, 214, 214*a*; etc. For example, as shown in FIG. 11A, the threaded region 322*b* may extend directly from the disc 222 such that no intermediate component 321 may be required. The threaded region 322*b* may threadingly connect to the threaded region 326*b* of shaft 324*b* near the middle of the hinge 200. Alternatively, as shown in FIG. 11B, the threaded region 322*c* of the shaft 320*c* may be sized and shaped to fit into a threaded region 326*c*, where the threaded region 326*c* may be disposed/located within, or in communication with, the disc 224*a* such that no shaft 324, 324*a*, 324*b* is included. Indeed, this arrangement permits the connection of the discs 222, 224*a* substantially near an end of the hinge 200 (e.g., near or in disc 224*a*, etc.). The shaft 320*c* may be sized and shaped to have substantially the same cross-section (e.g., substantially the same radius, substantially the same diameter, etc.) as the discs 222, 224*a* as shown in FIG. 11B. As shown in FIG. 11E, the threaded region 322*f* of the shaft 320*f* may extend from disc 222 and threadingly connect to the threaded region 326*f* inside the shaft 324*f*. Preferably, the threaded region 322*f* extends to and is in contact with a portion (e.g., such as the bottom, top or surface between the threads of the threaded region 326*f*, etc.) of the threaded region 326*f*. The cross-sections of the shafts 320*f*, 324*f* may be smaller than the cross-sections of the discs 222, 224. Any spacing illustrated between elements of one or more hinges 200 in FIGS. 11A-11E may be for diagrammatic illustrative purposes. Preferably, the shaft elements, e.g., 322*a*, 322*b*, 322*c*, 322*d*, 322*e*, 322*f*, 326, 326*a*, 326*b*, 326*c*, 326*d*, 326*f*, etc., are in contact with one or more portions of each other. In one or more embodiments, spacing may be employed in between such elements.

While a threaded connection is shown in at least FIGS. 9-10 11A, 11B and 11E, the present invention is not limited to this type of connection means. Other means of connecting two rods or shafts, e.g., shafts 320*a*, 324*a*, together may be employed, such as a press or snap fit (e.g., with a protrusion and a snap recess to receive that protrusion, ball-snap arrangement, etc.), friction fit, etc. Indeed, as shown in FIGS. 11C-11D, a snap or press fit connection may be employed to connect the shafts 320, 324 of the hinge 200 together. For example, as shown in FIG. 11C, the shaft 320*d* may extend from disc 222 substantially to the disc 224*b* where the shaft 320*d* includes a press or snap fit connection member 322*d* (e.g., a ball-snap element, a protrusion of a predetermined size and shape, etc.) that operates to snap or press fit into a snap or press fit receiving cavity 326*d* (e.g., such as a ball-snap shaped socket, a cavity that is sized and shaped to receive a protrusion of a predetermined size and shape, etc.). The snap or press fit receiving cavity 326*d* may be disposed/located in, and/or in communication with, the disc 224*b*. In at least a further embodiment as shown in FIG. 11D, a shaft 324*e* may extend from the disc 224 where the shaft 324*e* includes a snap or press fit receiving cavity 326*e* therein. A shaft 320*e* may extend from the disc 222 where the shaft 320*e* includes one or more press or snap fit connection members 322*e* (e.g., one or more ball-snap elements, one or more protrusions of a predetermined size and shape, etc.) that operate to snap or press fit into their respective one or more receiving cavities 326*e* (e.g., one or more ball-snap shaped sockets, one or more cavities that are sized and shaped to receive a protrusion of a predetermined size and shape, etc.). The shafts 320*e*, 324*e* may substantially meet and connect to each other near the middle of the hinge 200.

As discussed above, the pads 212, 214 may be sized and shaped depending on the desires, needs or requirements of the user of the percussion instrument 950. For example, as shown in FIG. 11D, the pads 212*a*, 214*a* may include a substantially flat or convex surface to allow a user to attain a desired grip therewith. Preferably, in one or more embodiments, the pads 212, 214 include rounded contours as shown in one or more of FIGS. 9-11C and 11E.

Additionally, the substantially perpendicular, substantially transverse, perpendicular and/or transverse hole, such as, but not limited to, the holes 150, 152, 154, 150*a*, 152*a*, 154*a*, etc., that extends through the body 100 of the stick 10 (e.g., across the longitudinal axis of the body 100 of the stick 10, along an axis that is not parallel to the longitudinal axis of the body 100 of the stick 10, along an axis that is transverse or substantially transverse to the longitudinal axis of the body 100 of the stick 10, along an axis that extends through the body 100 of the stick 10 and crosses over the longitudinal axis of the body 100 of the stick, along an axis that extends through, and crosses over from one side of the stick 10 to another side of the stick 10, along an axis that extends in a different direction (no matter how slight or substantial the difference) than the longitudinal axis of the body 100 of the stick 10, the two axes are different (e.g., the longitudinal axis and the axis of the hole are not parallel and are not co-linear), etc.) may be modified such that the stick 10 operates to allow a user thereof to perform one or more different drumming styles. For example, when performing the traditional, left-hand drumming style as described above (as opposed to a right hand, matched grip style or a French grip style), a user of the stick 10 having a hole (e.g., hole 150, 152, 154, 150*a*, 152*a*, 154*a*, etc.) may not be able to use, and/or will not feel comfortable using, the hinge 200 of the stick 10 when the hole 150, 152, 154, 150*a*, 152*a*, 154*a*, etc. is substantially perpendicular, substantially transverse, perpendicular and/or transverse (e.g., at about 90 degrees to both sides of the stick such that the hole 150, 152, 154, 150*a*, 152*a*, 154*a*, etc. is disposed at a right angle or substantially at a right angle to each side of the stick 10 when extending through the body 100 of the stick 10). This is because the drummer's wrists and/or elbow may be sticking out in the air at an uncomfortable angle or in an uncomfortable position with respect to the stick. Essentially, no drummer would want to hold his/her wrists and/or elbow in such an uncomfortable arrangement (e.g., the elbow is located away from the body for a lengthy period) when performing such drumming styles, particularly the traditional, left-hand drumming style.

Surprisingly, it has been found that, by modifying or creating the hole 150, 152, 154, 150*a*, 152*a*, 154*a*, etc. to have an angle (also referred to herein as "the alternative angle") that is about 10 degrees to about 45, or about 10 degrees to about 50 degrees, different from the right angle or the substantially right angle (best seen in FIG. 12), the configuration of the hinge 200 within the stick 10 would provide an efficient and optimal arrangement for the drummer such that the drummer could comfortably enjoy the benefits of the hinge 200 of the stick 10, especially for the traditional, left-hand drumming style because the drummer may comfortably rest his/her left elbow next to the drummer's body (e.g., similarly or in the same fashion as the right elbow already does). As such, depending on the angle of the holes 150, 152, 154, 150*a*, 152*a*, 154*a*, etc., the hinge 200 located in the hole 150, 152, 154, 150*a*, 152*a*, 154*a*, etc. may be used for one drumming style whereas in a hole having another angle, the hinge 200 may be used for a different drumming style or may be uncomfortable using in the same drumming style. Thus, by designing the angle of the hole 150, 152, 154, 150*a*, 152*a*, 154*a*, etc. based on the drumming style to be used, the drummer may use any of the described embodiments of the present invention for the one or more drumming styles in order to develop proper form while learning how to control the stick 10. While the sticks 10 are useful for teaching drummers how to perform one or more drumming styles, the sticks 10 may even be used by seasoned professionals to loosen up or warm up when training, before a performance, etc.

In one or more embodiments, the angle of the hole 150, 152, 154, 150*a*, 152*a*, 154*a*, etc. is preferably at least one of: positioned between about 80 degrees and about 45 degrees with respect to one or more sides of the stick 10, positioned between about 80 degrees and about 40 degrees with respect to one or more sides of the stick 10, positioned between about 70 degrees and about 45 degrees with respect to one or more sides of the stick 10, positioned between about 60 degrees and about 45 degrees with respect to one or more sides of the stick 10, positioned between about 50 degrees and about 45 degrees with respect to one or more sides of the stick 10, positioned at about 80 degrees with respect to one or more sides of the stick 10, positioned at about 75 degrees with respect to one or more sides of the stick 10, positioned at about 70 degrees with respect to one or more sides of the stick 10, positioned at about 65 degrees with respect to one or more sides of the stick 10, positioned at about 60 degrees with respect to one or more sides of the stick 10, positioned at about 55 degrees with respect to one or more sides of the stick 10, positioned at about 50 degrees with respect to one or more sides of the stick 10, positioned at about 45 degrees with respect to one or more sides of the stick 10, positioned at about 40 degrees with respect to one or more sides of the stick 10, positioned at about 35 degrees with respect to one or more sides of the stick 10, positioned at about 30 degrees with respect to one or more sides of the stick 10, positioned between about 105 degrees and about 110 degrees with respect to one or more sides of the stick 10, positioned between about 105 degrees and about 120 degrees with respect to one or more sides of the stick 10, positioned between about 105 degrees and about 130 degrees with respect to one or more sides of the stick 10, positioned between about 105 degrees and about 140 degrees with respect to one or more sides of the stick 10, positioned between about 105 degrees and about 150 degrees with respect to one or more sides of the stick 10, positioned between about 105 degrees and about 160 degrees with respect to one or more sides of the stick 10, positioned between about 105 degrees and about 170 degrees with respect to one or more sides of the stick 10, positioned at about 105 degrees with respect to one or more sides of the stick 10, positioned at about 110 degrees with respect to one or more sides of the stick 10, positioned at about 115 degrees with respect to one or more sides of the stick 10, positioned at about 120 degrees with respect to one or more sides of the stick 10, positioned at about 125 degrees with respect to one or more sides of the stick 10, positioned at about 130 degrees with respect to one or more sides of the stick 10, positioned at about 135 degrees with respect to one or more sides of the stick 10, positioned at about 140 degrees with respect to one or more sides of the stick 10, positioned at about 145 degrees with respect to one or more sides of the stick 10, positioned at about 150 degrees with respect to one or more sides of the stick 10, positioned at about 155 degrees with respect to t one or more sides of the stick 10, positioned at about 160 degrees with respect to one or more sides of the stick 10, positioned at about 165 degrees with respect to one or more sides of the stick 10, positioned at about 170 degrees with respect to one or more sides of the stick 10, and positioned at about 175 degrees with respect to one or more sides of the stick 10, etc.

Figure 12:
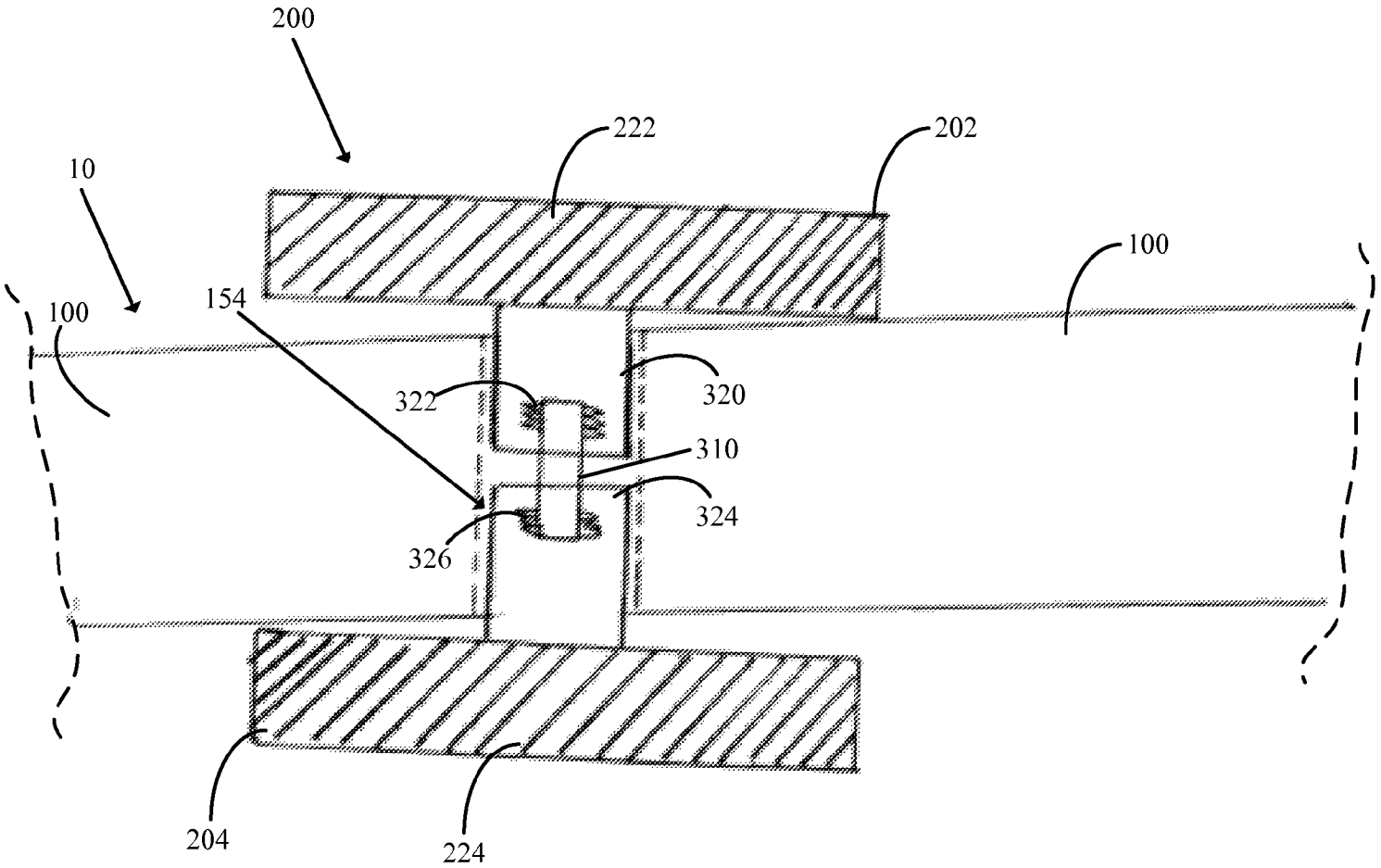
FIG. 12 is a sectional view of one or more further embodiments of a drumstick having an alternative hole extending through the body of the drumstick in accordance with one or more aspects of the present invention.
Figure 13:
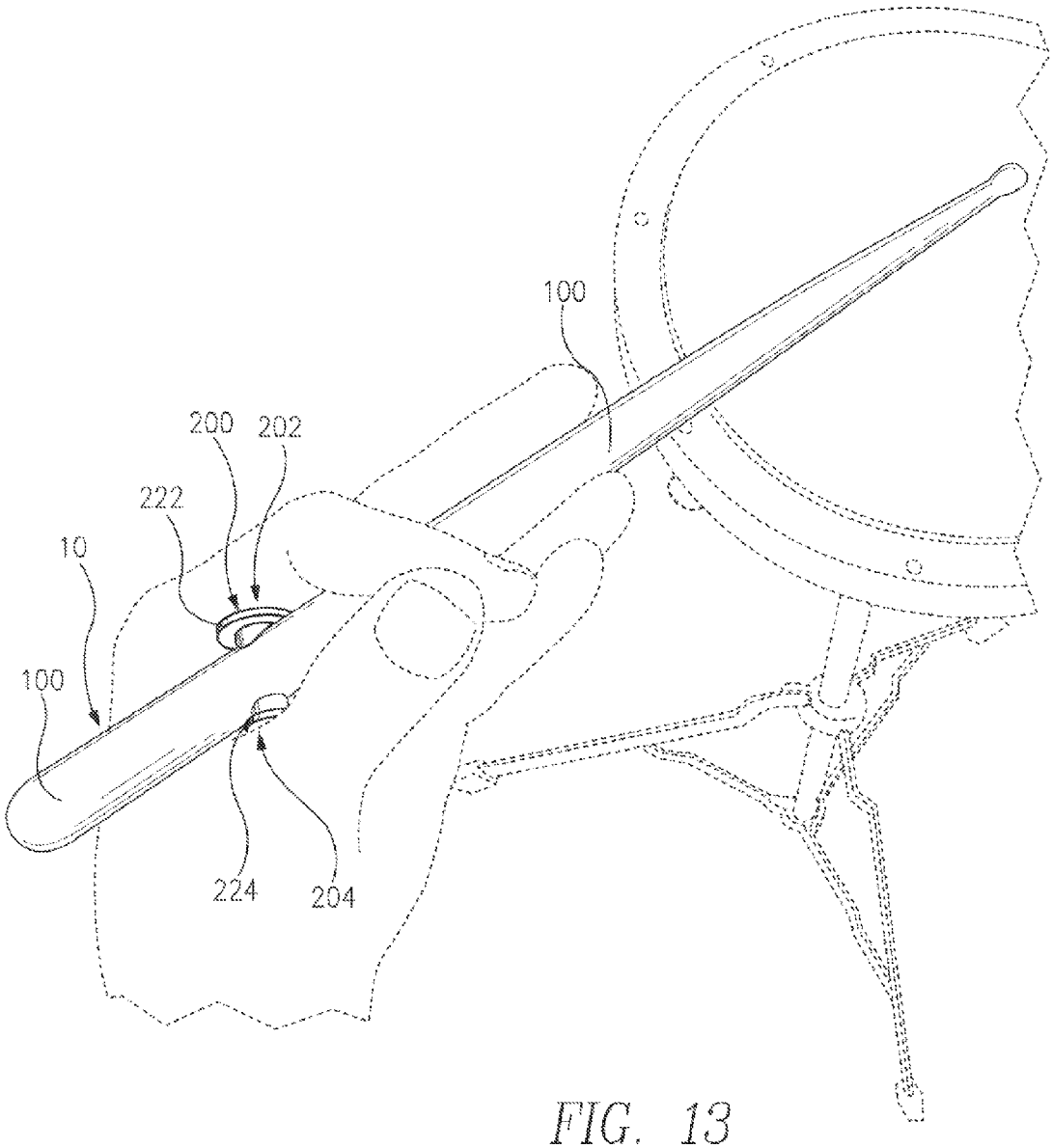
FIG. 13 is a perspective view of a drummer using one or more further embodiments of a drumstick having an alternative hole extending through the body of the drumstick in the traditional, left-hand drumming grip style in accordance with one or more aspects of the present invention.

Preferably, when looking at FIGS. 12-13 for illustrative purposes, the striking end of the body 100 of the stick 10 is the portion of the body 100 that extends beyond the right side of FIG. 12, and the butting end of the body 100 of the stick 10 is the portion of the body 100 that extends beyond the left side of FIG. 12. When performing the left-handed, traditional drumming style, preferably the hinge element 202 (as shown in FIG. 12) is located against the drummer's forefinger of the left hand (best seen in FIG. 13) such that the disc 222 is disposed against, in direct contact with, rests against, etc. the forefinger (e.g., against the base of the forefinger, at a predetermined location along the forefinger, above the base of the forefinger, etc.) of the left hand of the drummer, and the hinge element 204 (as shown in FIG. 12) is located against the drummer's thumb of the left hand (best seen in FIG. 13) such that the disc 224 is disposed against, in direct contact with, rests against, etc. the thumb (e.g., against the base of the thumb, at a predetermined location along the thumb, above the base of the thumb, etc.) of the left hand of the drummer. Preferably, the configuration is such that the discs 222, 224 are located comfortably at the base of the index finger and at the base of the thumb in order to have the elbow rest comfortably next to the drummer's body, for which the stick 10 may employ the one or more holes 150, 152, 154, 150*a*, 152*a*, 154, etc. having an angle to accommodate this configuration (e.g., approximately about 30 degrees or about 35 degrees or as otherwise described above) when the user/drummer is striking a drum with the stick 10 being located in of the left hand of the user/drummer. As such, the configuration preferably has the discs 222, 224 located comfortably against, and not uncomfortably jutting into, the one or more fingers of the user/drummer.

While FIG. 12 shows the hole 154 having an angle that is about 15 degrees different from a right angle or a substantially right angle (e.g., the hole is at about a 75 degree angle or at about a 105 degree angle depending on what side of the hole you measure the angle with respect to one of the sides of the stick 10) being used with the hinge 200 having the hinge elements 202, 204 with the discs 222, 224, the shafts 320, 324 having the threaded regions 322, 326 and the set screw 310 (e.g., similar to, or the same as, the hinge 200 as described above with respect to FIG. 5), the hole 154 having such an angle may be used with any type of hinge 200 or any other arrangement thereof described herein. For example, the hole 154 having the alternative angle may be used with, but is not limited to use with only, one or more of the following: the grooves 901 (see e.g., FIGS. 9-10); any of the components with alternative sizes and shapes as described above for FIGS. 11A-11E; the hinge clip device 700; one or more of the O-rings 330, 332; the compliance mechanism(s), such as, but not limited to the springs 410, 420, etc. While FIG. 12 shows a portion of the body 100 having the hole 154 therein and not the other portions of the body (i.e., as illustratively indicated by the dashed lines on ends of the portion of the body 100 having the hole 154 therein), such as, but not limited to, the portion(s) having holes 150, 152, etc., the hinge 200 may be positioned within the stick 10 when employing any of the other holes 150, 152, 154, 150*a*, 152*a*, 154*a*, etc. discussed herein. After all, while FIG. 12 focuses on the hole 154 for purposes of describing this aspect of the invention, a zoomed out view of FIG. 12 would show the remaining portions of the stick 10, including, for example, holes 150, 152, etc., the striking end of the stick 10 (as extending to the right side of FIG. 12 as explained above), the butt end of the stick 10 (as extending to the left side of FIG. 12 as explained above), and any other contours of the body 100 of the stick 10.

Figure 14:
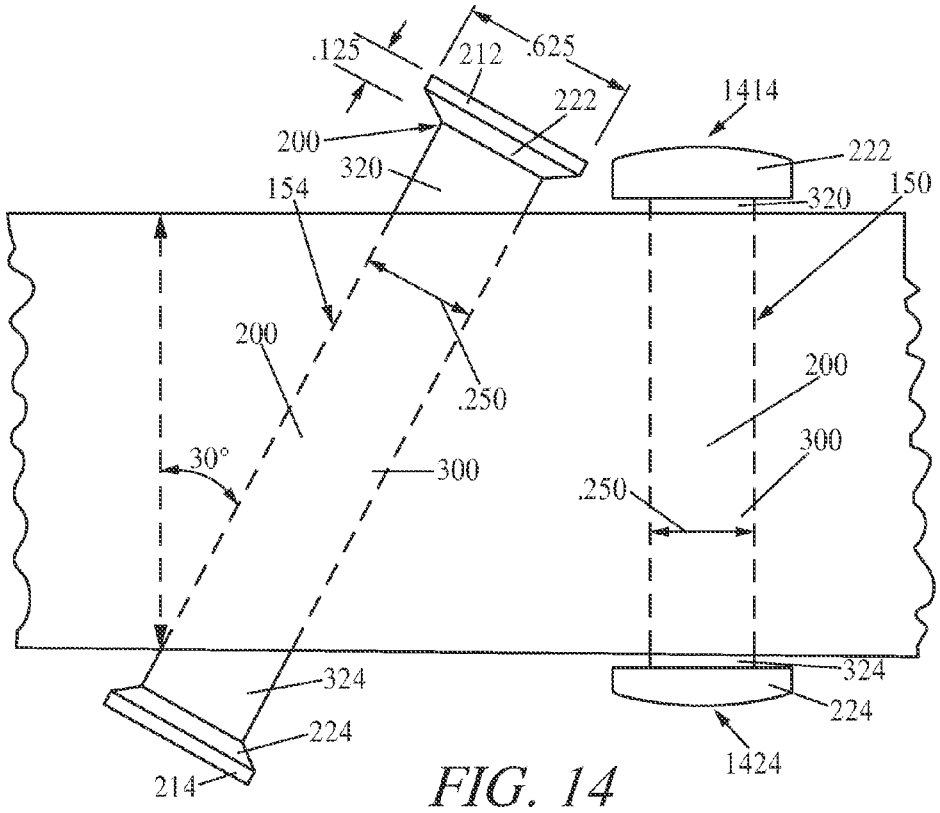
FIG. 14 is a side view of one or more further embodiments of a drumstick having two different types of holes extending through the body of the drumstick in accordance with one or more aspects of the present invention.
Figure 15:
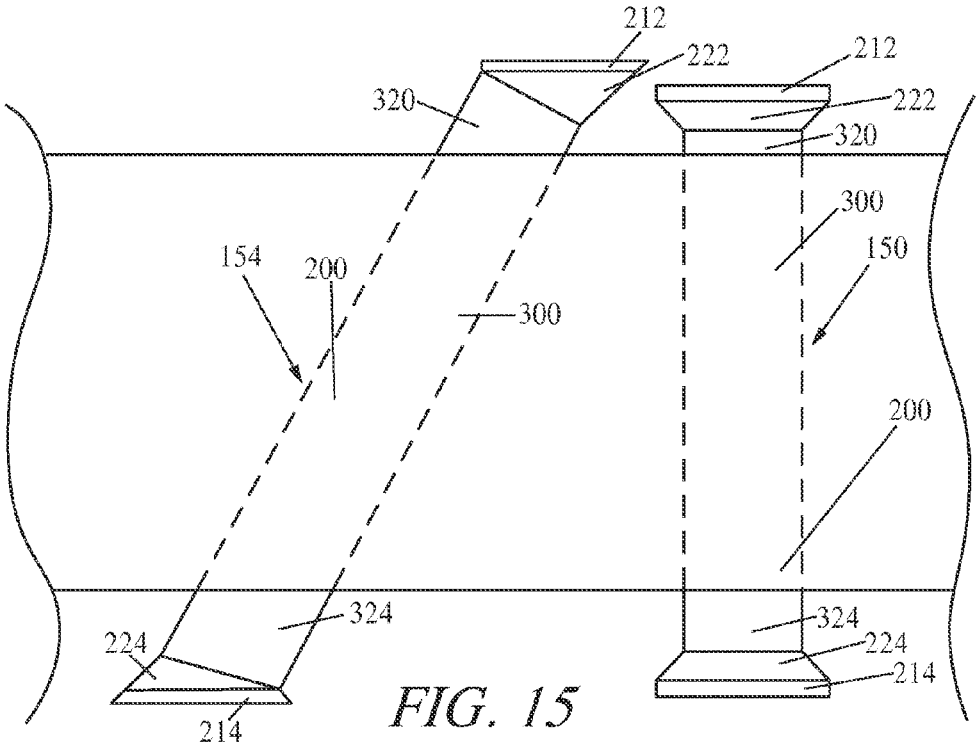
FIG. 15 is a side view of one or more further embodiments of a drumstick having two different types of holes extending through the body of the drumstick where the grasping mechanisms used in each of the holes have grip pads that are substantially parallel to the longitudinal axis of the drumstick that extends from the butt end to the striking end thereof in accordance with one or more aspects of the present invention.
Figure 17:
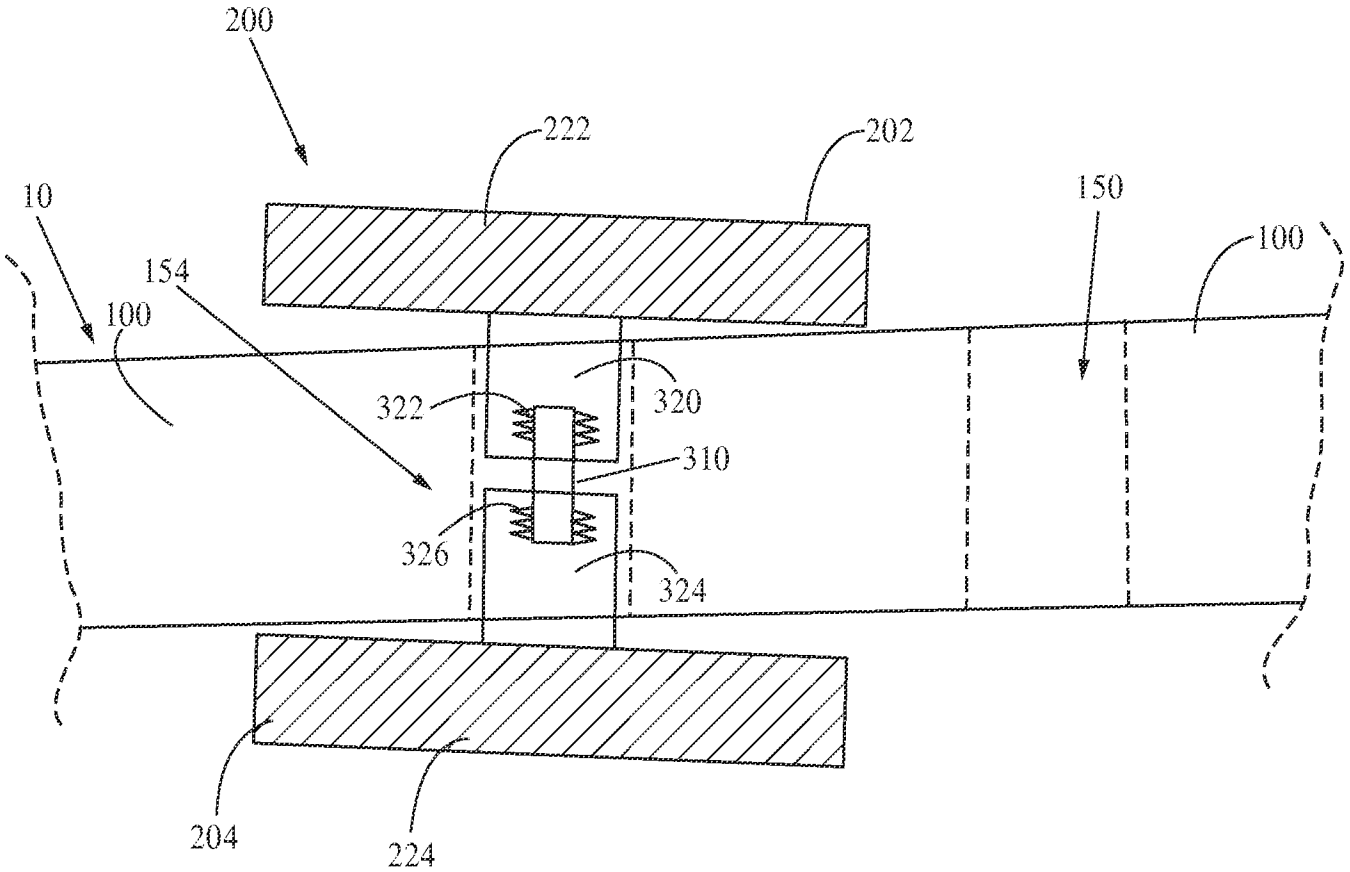
FIG. 17 a sectional view of one or more further embodiments of a drumstick having an alternative hole and a hole having an axis and/or angle that is different from the axis and/or angle of the alternative hole extending through the body of the drumstick in accordance with one or more aspects of the present invention.

As an additional surprise, it has been found that, in at least one embodiment of the present invention, by employing or creating at least two different types of holes in the body 100 of the stick 10 (e.g., the at least two different holes extend through the thickness of the body 100 of the stick 10 substantially along and/or through at least two axes that are different from each other and different from the longitudinal axis of the body 100), the user of the stick 10 may dispose a grasping mechanism or hinge (e.g., the grasping mechanism or the hinge 200) in the first hole and position/re-position the grasping mechanism or the hinge 200 in the second hole (or alternatively, from the second hole to the first hole) to perform different types of drumming styles with the same stick 10 (best seen in FIGS. 14-15 and 17). In one or more embodiments, the same stick 10 may be used for performing different types of drumming styles either without modifying the structure of the stick 10 or with a slight modification that requires no further structure, component(s), part(s), etc. for the stick 10 (e.g., the grasping mechanism or the hinge 200 may be moved from the first hole to the second hole or vice versa as shown in FIG. 17). Preferably, in at least one embodiment, the first hole (or the first type of hole) may be the same as or similar to, but not limited to, the hole 150, 152, 154, 150*a*, 152*a*, 154*a*, etc. as discussed above for the embodiments of FIGS. 1-11E (e.g., where the hole 150, 152, 154, 150*a*, 152*a*, 154*a*, etc. at least one of: extends through the thickness of the body 100 substantially along and/or through an axis that is different from the longitudinal axis of the body 100; extends through the thickness of the body 100 substantially along and/or through a substantially transverse axis of the body 100 through the thickness thereof; extends through the body 100 of the stick 10 at about ninety (about 90) degrees respective to one or more sides of the stick 10; extends through the body 100 of the stick 10 at about ninety (about 90) degrees respective to the longitudinal axis of the stick 10; extends through the body 100 of the stick 10 at a right angle or substantially at a right angle respective to the longitudinal axis of the stick 10; is substantially perpendicular, substantially transverse, perpendicular and/or transverse (e.g., at about 90 degrees to both sides of the stick 10 such that the hole 150 (see e.g., FIGS. 14-15 and 17), 152, 154, 150*a*, 152*a*, 154*a*, etc. is disposed at a right angle or substantially at a right angle to each side of the stick 10 when extending through the body 100 of the stick 10); etc.) such the user of the stick 10 may perform one or more drumming styles, such as, but not limited to, a right hand, matched grip style or a French grip style. Preferably, the configuration of the hinge 200 within the first hole 150, 152, 154, 150*a*, 152*a*, 154*a*, etc. of the stick 10 would provide an efficient and optimal arrangement for the drummer such that the drummer could comfortably enjoy the benefits of the hinge 200 of the stick 10, especially for the right hand, matched grip style or a French grip style.

Additionally, the second hole (or second type of hole) (best seen in FIGS. 14-15 and 17) may be the same as or similar to, but not limited to, the hole 150, 152, 154, 150*a*, 152*a*, 154*a*, etc. as discussed above for the embodiments of FIGS. 12-13 (e.g., where the hole 150, 152, 154, 150*a*, 152*a*, 154*a*, etc. at least one of: extends through the thickness of the body 100 substantially along and/or through an axis that is different from the longitudinal axis of the body 100; extends through the body 100 of the stick 10 at an angle that is different than about ninety (about 90) degrees respective to one or more sides of the stick 10; extends through the body 100 of the stick 10 at an angle that is different than about ninety (about 90) degrees respective to the longitudinal axis of the stick 10; extends through the body 100 of the stick 10 at an angle that is different than a right angle, or substantially different from a right angle, respective to the longitudinal axis of the stick 10; is not substantially perpendicular, substantially transverse, perpendicular and/or transverse (e.g., not at about 90 degrees to both sides of the stick 10 such that the hole 150, 152, 154, 150*a*, 152*a*, 154*a*, etc. is disposed at a right angle or substantially at a right angle to each side of the stick 10 when extending through the body 100 of the stick 10); extends through the thickness of the body 100 substantially along and/or through an axis that is different from the longitudinal axis of the body 100 and is different from the axis along and/or through which the first hole extends through the body 100; etc.) such that the user of the stick 10 may perform one or more different drumming styles, such as, but not limited to, the traditional, left handed grip style. Preferably, the second hole 150, 152, 154, 150*a*, 152*a*, 154*a*, etc. has the alternative angle as described above for the embodiment(s) of FIGS. 12-13 such that that the second hole 150, 152, 154, 150*a*, 152*a*, 154*a*, etc. has an angle (or the alternative angle) that is about 10 degrees to about 45, about 10 degrees to about 50 degrees, or about 30 degrees different from the right angle or the substantially right angle (best seen in FIG. 12). In one or more embodiments, the angle of the second hole 150, 152, 154, 150*a*, 152*a*, 154*a*, etc. may be at least one of: positioned between about 80 degrees and about 45 degrees with respect to one or more sides of the stick 10, positioned between about 80 degrees and about 40 degrees with respect to one or more sides of the stick 10, positioned between about 70 degrees and about 45 degrees with respect to one or more sides of the stick 10, positioned between about 60 degrees and about 45 degrees with respect to one or more sides of the stick 10, positioned between about 50 degrees and about 45 degrees with respect to one or more sides of the stick 10, positioned at about 80 degrees with respect to one or more sides of the stick 10, positioned at about 75 degrees with respect to one or more sides of the stick 10, positioned at about 70 degrees with respect to one or more sides of the stick 10, positioned at about 65 degrees with respect to one or more sides of the stick 10, positioned at about 60 degrees with respect to one or more sides of the stick 10, positioned at about 55 degrees with respect to one or more sides of the stick 10, positioned at about 50 degrees with respect to one or more sides of the stick 10, positioned at about 45 degrees with respect to one or more sides of the stick 10, positioned at about 40 degrees with respect to one or more sides of the stick 10, positioned at about 35 degrees with respect to one or more sides of the stick 10, positioned at about 30 degrees with respect to one or more sides of the stick 10, positioned between about 105 degrees and about 110 degrees with respect to one or more sides of the stick 10, positioned between about 105 degrees and about 120 degrees with respect to one or more sides of the stick 10, positioned between about 105 degrees and about 130 degrees with respect to one or more sides of the stick 10, positioned between about 105 degrees and about 140 degrees with respect to one or more sides of the stick 10, positioned between about 105 degrees and about 150 degrees with respect to one or more sides of the stick 10, positioned between about 105 degrees and about 160 degrees with respect to one or more sides of the stick 10, positioned between about 105 degrees and about 170 degrees with respect to one or more sides of the stick 10, positioned at about 105 degrees with respect to one or more sides of the stick 10, positioned at about 110 degrees with respect to one or more sides of the stick 10, positioned at about 115 degrees with respect to one or more sides of the stick 10, positioned at about 120 degrees with respect to one or more sides of the stick 10, positioned at about 125 degrees with respect to one or more sides of the stick 10, positioned at about 130 degrees with respect to one or more sides of the stick 10, positioned at about 135 degrees with respect to one or more sides of the stick 10, positioned at about 140 degrees with respect to one or more sides of the stick 10, positioned at about 145 degrees with respect to one or more sides of the stick 10, positioned at about 150 degrees with respect to one or more sides of the stick 10, positioned at about 155 degrees with respect to t one or more sides of the stick 10, positioned at about 160 degrees with respect to one or more sides of the stick 10, positioned at about 165 degrees with respect to one or more sides of the stick 10, positioned at about 170 degrees with respect to one or more sides of the stick 10, and positioned at about 175 degrees with respect to one or more sides of the stick 10, etc. Preferably, the configuration of the hinge 200 within the second hole 150, 152, 154, 150*a*, 152*a*, 154*a*, etc. of the stick 10 would provide an efficient and optimal arrangement for the drummer such that the drummer could comfortably enjoy the benefits of the hinge 200 of the stick 10, especially for the traditional, left-hand drumming style because the drummer may comfortably rest his/her left elbow next to the drummer's body (e.g., similarly or in the same fashion as the right elbow already does).

As such, depending on the angle of the holes 150, 152, 154, 150*a*, 152*a*, 154*a*, etc., the hinge 200 located in the first hole 150, 152, 154, 150*a*, 152*a*, 154*a*, etc. may be used for at least one drumming style whereas in the second hole 150, 152, 154, 150*a*, 152*a*, 154*a*, etc. (i.e., in a different hole having another angle), the hinge 200 may be used for one or more different drumming styles or may be uncomfortable using in the same drumming style. Thus, by designing the angle of the hole 150, 152, 154, 150*a*, 152*a*, 154*a*, etc. based on the drumming style to be used, the drummer may use any of the described embodiments of the present invention for the one or more drumming styles in order to develop proper form while learning how to control the stick 10. While the sticks 10 are useful for teaching drummers how to perform one or more drumming styles, the sticks 10 may even be used by seasoned professionals to loosen up or warm up when training, before a performance, etc.

In at least one embodiment, the pads 212, 214 and/or the grip portions 222, 224 of the grasping mechanism 200 disposed in the first hole 150, 152, 154, 150*a*, 152*a*, 154*a*, etc. may have a different size and/or shape from the pads 212, 214 and/or the grip portions 222, 224 of the grasping mechanism 200 disposed in the second hole 150, 152, 154, 150*a*, 152*a*, 154*a*, etc. For example, the grip portions or grip plates 222, 224 may be chamfered at an angle equal to, or substantially equal to, the angle at which the shaft (e.g., the shaft(s) 320 (see e.g., FIGS. 14-15), 324 (see e.g., FIGS. 14-15), 320*a*, 324*a*, 320*b*, 320*c*, 320*d*, 320*e*, 320*f*, 324*b*, 324*c*, 324*d*, 324*e*, 324*f*) of the grasping mechanism 200 is disposed in relation to the body 100 of the stick 10. For example, the chamfer of the grip portions or grip plates 222, 224 may be 30 degrees or about 30 degrees. Additionally or alternatively, the grip portion or grip plates 222, 224 may be chamfered, sloped and/or tapered from the shaft (e.g., the shaft 320) of the grasping mechanism 200 to their respective pads 212, 214 of the grasping mechanism 200 (e.g., the sides of the plates 222, 224 extend outwardly from the shaft (e.g., the shaft 320) of the grasping mechanism 200 to their respective pads 212, 214 as best seen in FIGS. 14-15). The height of the grip plates 222, 224 and the pads 212, 214 may be 0.125 inches (e.g., the collective height of the grip plate 222 and the respective pad 212 is about 0.125 inches or is 0.125 inches; the collective height of the grip plate 224 and the respective pad 214 is about 0.125 inches or is 0.125 inches). Preferably, the length or diameter of the largest part of the grip plates 222, 224 and/or the pads 212, 214 is about 0.625 inches or 0.625 inches. The length or diameter of the largest part of the grip plates 222, 224 (e.g., the head portion that a user of the stick 10 grasps or contacts, the thickest or longest part of the grip plates 222, 224; the thickest or longest part of the grip or disk portions 202, 204; etc.) may be about ¾ of an inch. The thickness of the largest part of the grip plates 222, 224 (e.g., the head portion that a user of the stick 10 grasps or contacts, the thickest or longest part of the grip plates 222, 224; the thickest or longest part of the grip or disk portions 202, 204; etc.) may be about ¼ of an inch. For example, the collective height of the grip plate 222 and the respective pad 212 may be about ¼ of an inch, and the collective height of the grip plate 224 and the respective pad 214 may be about ¼ of an inch. In such an embodiment, the collective height of ¼ of an inch may comprise about half (⅛ of an inch) being the height of the pads 212, 24 and about half (⅛ of an inch) being the height of the grip plates 222, 224. Preferably, when the grip plates 222, 224 include a chamfered surface (as best seen in FIG. 14), the grip plates 222, 224 have a height of ⅛ of an inch. The shafts 320, 324 may be ¼ of an inch in diameter. Preferably, when the grasping mechanism 200 is positioned within the first hole 150, 152, 154, 150*a*, 152*a*, 154*a*, etc., the pads 212, 214 and/or the gripping surfaces of the grip plates 222, 224 are disposed at about zero (0) degrees in relation to one or more sides of the stick 10 and/or in relation to the longitudinal axis of the stick 10 (best seen in FIGS. 14-15). Preferably, when the grasping mechanism 200 is positioned within the second hole 150, 152, 154, 150*a*, 152*a*, 154*a*, etc., the pads 212, 214 and/or the gripping surfaces of the grip plates 222, 224 are disposed at about 30 degrees in relation to one or more sides of the stick 10 and/or in relation to the longitudinal axis of the stick 10 (best seen in FIG. 14). Preferably, the grasping mechanism 200 that is positioned within the second hole 150, 152, 154, 150*a*, 152*a*, 154*a*, etc. has grip plates 222, 224 each having at least one or two chamfered sides (best seen in FIGS. 14-15). Alternatively, when the grasping mechanism 200 is positioned within the second hole 150, 152, 154, 150*a*, 152*a*, 154*a*, etc., the pads 212, 214 and/or the gripping surfaces of the grip plates 222, 224 may be disposed at a predetermined angle discussed above, such as, but not limited to, zero degrees in relation to one or more sides of the stick 10 and/or in relation to the longitudinal axis of the stick 10 (best seen in FIG. 15) or any other angle. The angle of the grasping mechanism 200 in relation to the stick 10 may be dependent upon the angle of the second hole 150, 152, 154, 150*a*, 152*a*, 154*a*, etc.

Additionally or alternatively, as best seen in FIG. 14, the grasping mechanism 200 may include grip plates 222, 224 that have a flat surface facing the body 100 of the stick 10, a side surface or perimeter that extends from the flat surface facing the body 100 of the stick 10 at a right angle or at an angle that is about 90 degrees. From the side surface or perimeter extends another surface that is sloped and/or tapered to a flat surface 1414, 1424. Preferably, the flat surface 1414, 1424 of the grip plates 222, 224, respectively, have a length or a diameter that is smaller or shorter than the length or the diameter of the longest section of the grip plates 222, 224 (best seen in FIG. 14). In one or more embodiments, the sloped and/or tapered surface extending from the side surface or perimeter of the grip plates 222, 224 may be uninterrupted by the flat surfaces 1414, 1424 (e.g., the grip plates 222, 224 do not employ the flat surfaces 1414, 1424 such that the sloped and/or tapered surface extends at least one of: (i) radially from at least one side to another side of the perimeter or side surface of the grip plates 222, 224; and (ii) radially from all sides to all other sides of the perimeter or side surface of the grip plates 222, 224 (e.g., all along the circumference of the side surface or perimeter of the grip plates 222, 224). Preferably, such grip plates 222, 224 (e.g., grip plates 222, 224 without the aforementioned chamfered surfaces extending between the shafts 320, 324 to the pads 212, 214) are used such that the respective spaces between the body 100 of the stick 10 and the grip plates 222, 224 are reduced and/or minimized, thereby reducing the rattling of the grasping mechanism 200 within the first hole 150 (as shown in FIG. 14), 152, 154, 150*a*, 152*a*, 154*a*, etc. of the body 100 of the stick 10. In at least one embodiment, such grip plates 222, 224 may be used with or without (as shown in FIG. 14) the pads 212, 214. Alternatively, as shown in FIG. 15, the grip plates 222, 224 having the chamfered surfaces extending between the shafts 320, 324 and the pads 212, 214 may be used.

Additionally or alternatively, the grasping mechanism or the hinge 200 may be disposed in the first hole 150, 152, 154, 150*a*, 152*a*, 154*a*, etc. and an additional grasping mechanism or hinge 200 may be disposed in the second hole 150, 152, 154, 150*a*, 152*a*, 154*a*, etc. at the same time (see e.g., FIGS. 14-15) such that the user of the stick 10 may switch between grasping mechanisms or hinges 200 while performing with the same stick 10 (e.g., without having to modify the structure of the stick 10 when switching between drumming styles), thereby being able to comfortably, conveniently perform one or more different drumming styles with the same stick 10. As explained above, before the subject invention of the instant application, the user of a stick 10 had to change sticks 10 in order to perform different types of drumming styles (e.g., switching between one stick 10 that operates to permit a user to perform the right hand, matched gripping style and another stick 10 that operates to permit the user to perform the traditional, left handed gripping style; switching between one stick 10 that operates for performing one type of drumming style and another stick 10 that operates for performing another type of drumming style; etc.).

Preferably, when looking at FIGS. 14-15 and 17 for illustrative purposes, the striking end of the body 100 of the stick 10 is the portion of the body 100 that extends beyond the right sides of FIGS. 14-15 and 17, and the butting end of the body 100 of the stick 10 is the portion of the body 100 that extends beyond the left sides of FIGS. 14-15 and 17. In one or more further embodiments, the first and second holes 150, 152, 154, 150*a*, 152*a*, 154*a*, etc. may be switched such that the first hole 150, 152, 154, 150*a*, 152*a*, 154*a*, etc. is closer to the butting end of the body 100 of the stick 10 and the second hole 150, 152, 154, 150*a*, 152*a*, 154*a*, etc. is closer to the striking end of the body 100 of the stick.

As best seen in FIGS. 14-15 and 17, preferably, the pads 212, 214 of the grip plates 222, 224 of each grasping mechanism or hinge 200 are substantially parallel or parallel to each other (e.g., the pad 212 of the grasping mechanism 200 located in the first hole 150, 152, 154, 150*a*, 152*a*, 154*a*, etc. is substantially parallel or parallel to the pad 214 of the grasping mechanism 200 located in the first hole 150, 152, 154, 150*a*, 152*a*, 154*a*, etc.; the pad 212 of the grasping mechanism 200 located in the second hole 150, 152, 154, 150*a*, 152*a*, 154*a*, etc. is substantially parallel or parallel to the pad 214 of the grasping mechanism 200 located in the second hole 150, 152, 154, 150*a*, 152*a*, 154*a*, etc.; etc.). Additionally or alternatively, a gripping surface (e.g., the surface of the grip portion via which the user grips the grasping mechanism or hinge 200) of each of the grip plates 222, 224 of each grasping mechanism or hinge 200 are substantially parallel or parallel to each other (e.g., the gripping surface of the grip plate 222 of the grasping mechanism 200 located in the first hole 150, 152, 154, 150*a*, 152*a*, 154*a*, etc. is substantially parallel or parallel to the gripping surface of the grip plate 224 of the grasping mechanism 200 located in the first hole 150, 152, 154, 150*a*, 152*a*, 154*a*, etc.; the gripping surface of the grip portion 222 of the grasping mechanism 200 located in the second hole 150, 152, 154, 150*a*, 152*a*, 154*a*, etc. is substantially parallel or parallel to the gripping surface of the grip portion 224 of the grasping mechanism 200 located in the second hole 150, 152, 154, 150*a*, 152*a*, 154*a*, etc.; etc.). Additionally or alternatively, the pads 212, 214 and/or the gripping surfaces of the grip portions 222, 224 may be sized and shaped as discussed above (e.g., the pads 212, 214 and/or the gripping surfaces or any other surface(s) of the grip portions 222, 224 may be at least one of: chamfered, sloped, convex, concave, tapered, etc.; see e.g., FIGS. 14-15). A user of the stick 10 may change the pads 212, 214 and/or the grip portions 202, 204 depending on the size and/or shape of the first and second holes. For example, if the second hole 150, 152, 154, 150*a*, 152*a*, 154*a*, etc. is disposed at a 30 degree angle (and/or at the alternative angle as discussed above) in at least one embodiment, the grasping mechanism 200 positioned therein may be longer than the straight grasping mechanism 200 positioned in the first hole 150, 152, 154, 150*a*, 152*a*, 154*a*, etc. Thus, if the straight grasping mechanism 200 were moved into the second hole 150, 152, 154, 150*a*, 152*a*, 154*a*, etc., a user may exchange the grip pads 212, 214 and/or one or more portions of the grip portions 202, 204 (e.g., the grip plates 222, 224), thereby adjusting the length of the grasping mechanism 200 such that there would not be too much empty space when using the grasping mechanism 200 interchangeably between the first and second holes 150, 152, 154, 150*a*, 152*a*, 154*a*, etc.

As discussed above (see e.g., FIGS. 5-6 and related discussion above), in at least one embodiment of the invention, the body 100 is preferably freely pivotally mobile with respect to fastener 300, thereby enabling the desirable free rotational motion of body 100 for both learning and performing purposes. When a user of drumstick 10 wishes to limit the rotational speed and/or the angular displacement of body 100 with respect to fastener 300, the user may shift the location of the compressive holding force on grip plates 222, 224 so as to deflect the edges of grip plates 222 and 224 about deflection recesses 334 and 344 respectively, and in turn cause O-rings 330 and 332 to impinge on body 100 of drumstick 10, which thereby operates to hinder the rotational motion of body 100 with respect to fastener 300. In this manner, the rotational speed and/or the angular motion range of body 100 with respect to fastener 300 may be controlled as a function of the location and magnitude of the compressive force applied by the user to the respective grip plates 222, 224. Moreover, the extent and location of the applied force is under the control of the user of drumstick 10, thereby enabling the user to either allow unimpeded pivotal motion of drumstick 10 or to controllably dampen the motion of drumstick 10 in response to the compressive force applied by the user.

Figure 16:
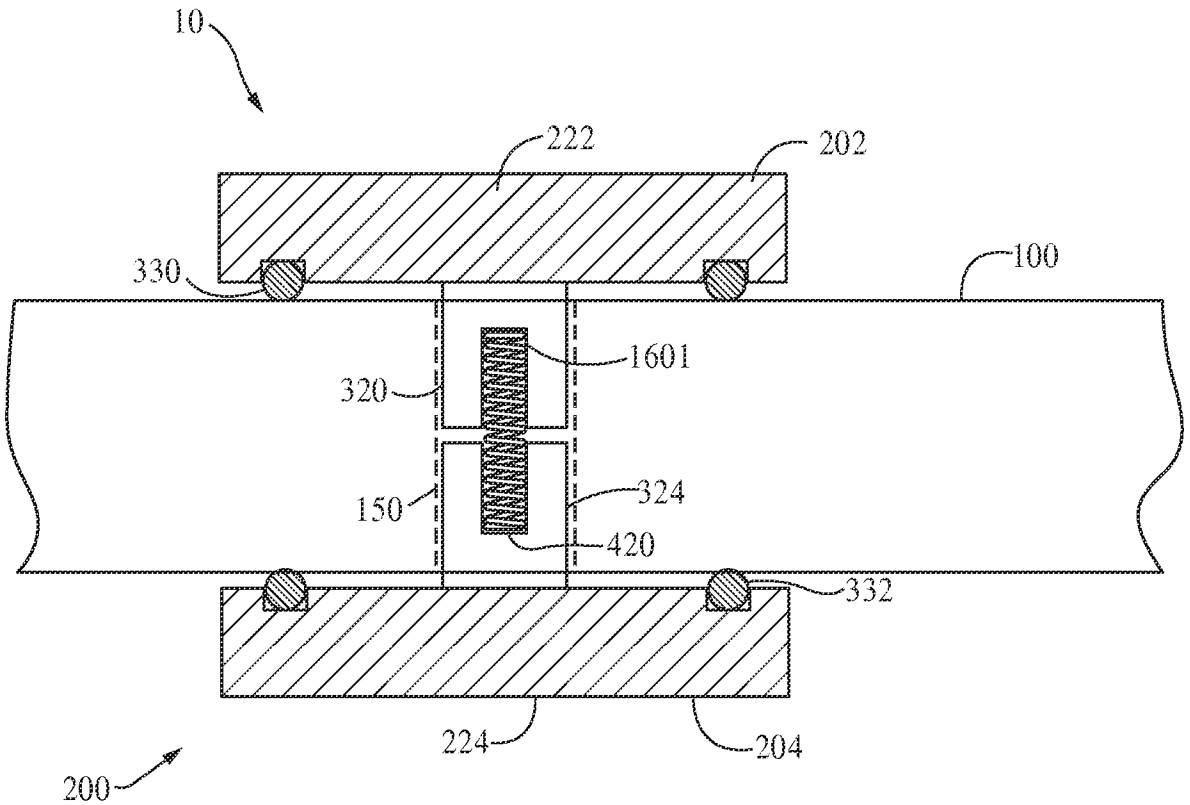
FIG. 16 is a schematic sectional view of a hinge coupled to a body of a drumstick in accordance with a further embodiment of the present invention.

Additionally or alternatively, at least one of the springs 410, 420 (or any other spring sufficient to operate as discussed herein) may be employed to enable spring-loaded transverse-axis relative movement between the disk portion 402 and disk portion 404. We turn now to the operation of the drumstick 10 of FIG. 16. Preferably, the body 100 has a longitudinal axis extending from a butt end to a striking end thereof and at least one hole (e.g., the hole 150 (as shown in FIG. 16), 152, 154, 150*a*, 152*a*, 154*a*, etc.) extending through the thickness of the body 100 substantially along and/or through an axis that is different from the longitudinal axis. Preferably, the grasping mechanism 200 has a first grip plate 222 at a first end thereof and a second grip plate 224 at a second end thereof, and a fastener (e.g., the fastener 300 as discussed above, the arrangement of the shafts 320, 324 as shown in FIG. 16, at least one of the springs 410, 420 connected directly to the grip plates 222, 224, etc.) extending from the first grip plate 222 through the hole (e.g., the hole 150 (as shown in FIG. 16), 152, 154, 150*a*, 152*a*, 154*a*, etc.) in the body 100 to the second grip plate 224. Preferably, when using a single spring (e.g., the springs 410, 420) as a component of the fastener 300, the fastener 300 at least one of: (i) includes a first shaft connected to the first grip plate 222 (e.g., the shaft 320 as shown in FIG. 16), a second shaft connected to the second grip plate 224 (e.g., the shaft 324 as shown in FIG. 16) and a compliance mechanism (e.g., the at least one of the springs 410, 420) located between the first and second shafts 320, 324; and (ii) comprises a compliance mechanism (e.g., the at least one of the springs 410, 420) disposed between the first and second grip plates 222, 224 (e.g., without using the shafts 320, 324; the compliance mechanism may extend directly from, and between, the grip plates 222, 224; the compliance mechanism (e.g., the at least one of the springs 410, 420) may be integral with or connected directly (e.g., via bonding, gluing, fusing, adhering, press-fitting, friction-fitting, etc.) to the grip plates 222, 224; etc.). By way of example of at least one embodiment as best seen in FIG. 16, at least a first portion of the spring (e.g., the spring 420) may be disposed in a cavity 1601 of the shaft 320 and at least a second portion of the spring (e.g., the spring 420) may be disposed in a cavity 1601 of the shaft 324, and the spring (e.g., the spring 420) may be held within the cavities 1601 by any of the aforementioned methods (e.g., via bonding, gluing, fusing, adhering, press-fitting, friction-fitting, etc.) or any other method known to those skilled in the art. As best seen in FIG. 16, the spring (e.g., the spring 420) may include a third portion thereof that extends between the respective cavities 1601 of the shafts 320, 324 such that the third portion of the spring (e.g., the spring 420) is not located within the cavities 1601, thereby allowing the spring (e.g., the spring 420) to operate as the compliance mechanism as discussed herein (e.g., the shafts 320, 324 may be compressed towards each other or may expand away from each other, the grip plates 222, 224 may be compressed towards each other or may expand away from each other; etc.). Preferably, the compliance mechanism operates to enable the first and second grip plates 222, 224 to be moved closer together in response to a compressive force applied to the at least one grasping mechanism 200. Additionally or alternatively, the compliance mechanism may comprise any other device discussed herein and/or any other device known to those skilled in the art as possessing such structural attribute(s), i.e., having compressive, resilient operability. Preferably, the compliance mechanism comprises at least one spring 410, 420, and the at least one spring 410, 420 may be connected to one or more other components of the grasping mechanism 200 (e.g., may be integral with or connected directly (e.g., via bonding, gluing, fusing, adhering, press-fitting, friction-fitting, etc.) to the grip plates 222, 224; etc.) As similarly described for the embodiments shown in at least FIGS. 14-15, the embodiment of FIG. 16 (while not being limited to only these dimensions) may have the same or similar dimensions as described above. For example, the height of the grip plates 222, 224 and the pads 212, 214 may be 0.125 inches (e.g., the collective height of the grip plate 222 and the respective pad 212 is about 0.125 inches or is 0.125 inches; the collective height of the grip plate 224 and the respective pad 214 is about 0.125 inches or is 0.125 inches). Preferably, the length or diameter of the largest part of the grip plates 222, 224 and/or the pads 212, 214 is about 0.625 inches or 0.625 inches. The length or diameter of the largest part of the grip plates 222, 224 (e.g., the head portion that a user of the stick 10 grasps or contacts, the thickest or longest part of the grip plates 222, 224; the thickest or longest part of the grip or disk portions 202, 204; etc.) may be about ¾ of an inch. The thickness of the largest part of the grip plates 222, 224 (e.g., the head portion that a user of the stick 10 grasps or contacts, the thickest or longest part of the grip plates 222, 224; the thickest or longest part of the grip or disk portions 202, 204; etc.) may be about ¼ of an inch. For example, the collective height of the grip plate 222 and the respective pad 212 may be about ¼ of an inch, and the collective height of the grip plate 224 and the respective pad 214 may be about ¼ of an inch. In such an embodiment, the collective height of ¼ of an inch may comprise about half (⅛ of an inch) being the height of the pads 212, 24 and about half (⅛ of an inch) being the height of the grip plates 222, 224. Preferably, when the grip plates 222, 224 include a chamfered surface (as best seen in FIG. 14), the grip plates 222, 224 have a height of ⅛ of an inch. The shafts 320, 324 may be ¼ of an inch in diameter.

As with other embodiments discussed above, preferably, at least one of: (i) the axis of the hole and the longitudinal axis of the body at least one of: extend in different directions, are not parallel and are not co-linear; and (ii) the axis of the hole extends at least one of: across the longitudinal axis of the body; is transverse or substantially transverse to the longitudinal axis of the body; is perpendicular or substantially perpendicular to the longitudinal axis of the body; through the body and crosses over the longitudinal axis of the body; and along an axis that extends through, and crosses over from one side of the body to another side of the body.

Additionally or alternatively, one or more embodiments of the stick 10 using the compliance mechanism may include first and second frictional contact devices (see e.g., the O-rings 330, 332 in FIG. 16 and as discussed above for other embodiments). Preferably, at least one of: (i) the first frictional contact device comprises a first O-ring 330 and the second frictional contact device comprises a second O-ring 332; (ii) the first and second frictional contact devices are located between an outside surface of the body 100 and the inside surfaces of the first and second grip plates 222, 224, respectively; (iii) the first and second frictional contact devices are located between the body 100 and the first and second grip plates 222, 224, respectively; (iv) the first and second grip plates 222, 224 each include a groove 334, 344 (see e.g., FIGS. 5-6 and FIG. 16) disposed on, and in communication with, the inside surfaces of the first and second grip plates 222, 224, the groove 334 of the first grip plate 222 operating to house the respective first frictional contact device (e.g., the O-ring 330) therein and the groove 344 of the second grip plate 224 operating to house the respective second frictional contact device (e.g., the O-ring 332) therein; and (v) the first and second frictional contact devices operate to provide a braking function for slowing and/or stopping the relative motion between the body 100 and the first and second grip plates 222, 224 and/or the grasping mechanism 200 when at least one of the first frictional contact device and the second frictional contact device is brought into contact with the body 100 of the drumstick 10.

When free motion of the body 100 with respect to the hinge 200 (including the disk portions 202, 204) is desired, a user preferably holds the disk portions or plates 222, 224 with a compressive force sufficiently small so that the first and second frictional contact devices, such as, but not limited to, the O-rings 330, 332, do not impart any significant frictional braking force against the body 100 of the drumstick 10. When a user wishes to control the pivotal speed and/or extent of pivotal motion of the body 100 with respect to the disk portions or plates 222, 224, the user may hold the disk portions or plates 222 and 224 with a compressive force sufficient to move these two parts towards one another and thereby bring the first and second frictional contact devices, such as, but not limited to, the O-rings 330, 332, into contact with the body 100, thereby imparting a frictional braking force to the body 100. As also mentioned above, one or more portions of the grip plates 222, 224 may be used to impart a frictional braking force to the body 100. Thereafter, the braking effect may be adjusted by the user by adjusting the amount of compressive force used to hold the disk portions or plates 222 and 224. If desired, one or more of the compliance features of FIGS. 5-6 and FIG. 16 may be combined within a single embodiment. Thus, one or both of springs 410, 420 could be included along with one or more of deflection recesses 336, 346.

While the above embodiments involve using O-rings 330, 332 as the entity making frictional contact with body 100, i.e., as the "braking material" or the first and second frictional contact devices, the present invention is not limited to the use of O-rings. Other materials having other shapes may be employed either in addition to, or in place of, O-rings 330, 332. Additionally or alternatively, a portion of the first and second grip plates 222, 224 (such as, but not limited to, the inside surfaces of the grip plates 222, 224; the surfaces of the grip plates 222, 224 that are closer or closest to the body 100 of the stick 10; etc.) may be used as the first and second frictional contact devices, respectively, with or without the use of the O-rings 330, 332 as discussed above. Additionally or alternatively, any other frictional contact devices may be used as known to those skilled in the art. Other materials for the frictional contact device(s) (i.e., the role of O-rings 330, 332 in FIG. 6) may include, but are not limited to, plastic, rubber, wood, fiberglass, metal, or any combination of the foregoing. In still other embodiments, the presence of a braking material separate from disk portions 222 and 224 may be omitted entirely. Where such separate braking material is omitted, friction between the internal surfaces of disk portions 202, 204 themselves and the body 100 could be used to brake and/or control the motion of body 100 with respect to the disk portions 222 and 224.

As discussed above, while two springs 410, 420 are shown in FIG. 6, it will be appreciated that three or more springs could be employed. Moreover, the invention may be practiced using only a single spring (as best seen in FIG. 16). Moreover, the one or more springs providing the needed compliance need not be located as the one or more springs 410, 420 are shown in FIGS. 6 and 16. Compliant devices, such as springs, could be located at any point that would allow the disk portions 222 and 224 to move closer together upon the application of compressive force between these two parts.

In the embodiments of FIGS. 1-16 or alternative embodiments, the following variations could be practiced to benefit various embodiments of the invention: (1) the use of different hole diameters; (2) the use of different hole locations; (3) the use of a different size or type of stick; (4) the use of a different drum stick tip (wood or nylon); (5) the use of a timpani stick; (6) a variation in the diameter of the portion of fastener 300 extending though hole 150; (7) the use of a different diameter (or shape) of the disk portions 222, 224 of the hinge elements 202, 204; and/or (8) the use of different means of securing together the shaft portions 320, 324 that engage one another within hole 150.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A percussion instrument comprising:

a body having a longitudinal axis extending from a butt end to a striking end thereof and at least two holes extending through the thickness of the body substantially along and/or through a respective axis that is different from the longitudinal axis and that is different from the axis of the other hole of the at least two holes;

at least one grasping mechanism having a first grip plate at a first end thereof and a second grip plate at a second end thereof, at least one shaft extending from the first grip plate through a first hole of the at least two holes in the body to the second grip plate, and a releasable connection between the first grip plate and the second grip plate such that the at least one grasping mechanism operates to be positioned in the first hole of the at least two holes and the first grip plate and the second grip plate operate to be disconnected from each other and re-connected to each other such that the at least one grasping mechanism operates to be positioned in a second hole of the at least two holes or re-positioned in the first hole of the at least two holes, the first hole extending through the thickness of the body and disposed at least one of: at a right angle in relation to the longitudinal axis, at substantially a right angle in relation to the longitudinal axis, transversely to the longitudinal axis, substantially transversely to the longitudinal axis, at an angle that is about ninety degrees with respect to the body and at an angle that is ninety degrees with respect to the body, the second hole of the at least two holes extending through the thickness of the body and disposed at least one of: at an angle different from the angle of the first hole, at an angle that is not a right angle in relation to the longitudinal axis, at an angle that is not substantially a right angle in relation to the longitudinal axis, not transversely to the longitudinal axis, not substantially transversely to the longitudinal axis, at an angle other than about ninety degrees with respect to the body and at an angle other than ninety degrees with respect to the body; and a compliance mechanism disposed between the first and second grip plates, enabling the first and second grip plates to be moved closer together in response to a compressive force applied to the at least one grasping mechanism.

2. The percussion instrument of claim 1, wherein:

(i) the body includes at least a first side extending between the butt end and the striking end of the body and at least a second side extending between the butt end and the striking end of the body;

(ii) the angle of the first hole of the at least two holes is at least one of: positioned between about 80 degrees and about 100 degrees with respect to the first side, the second side or the longitudinal axis of the body; positioned at about 90 degrees with respect to the first side, the second side or the longitudinal axis of the body; positioned at substantially 90 degrees with respect to the first side, the second side or the longitudinal axis of the body and positioned at 90 degrees with respect to the first side, the second side or the longitudinal axis of the body; and (iii) the angle of the second hole of the at least two holes is at least one of: positioned between about 80 degrees and about 45 degrees with respect to the first side or the second side, positioned between about 80 degrees and about 40 degrees with respect to the first side or the second side, positioned between about 70 degrees and about 45 degrees with respect to the first side or the second side, positioned between about 60 degrees and about 45 degrees with respect to the first side or the second side, positioned between about 50 degrees and about 45 degrees with respect to the first side or the second side, positioned at about 80 degrees with respect to the first side or the second side, positioned at about 75 degrees with respect to the first side or the second side, positioned at about 70 degrees with respect to the first side or the second side, positioned at about 65 degrees with respect to the first side or the second side, positioned at about 60 degrees with respect to with respect to the first side or the second side, positioned at about 55 degrees with respect to with respect to the first side or the second side, positioned at about 50 degrees with respect to the first side or the second side, positioned at about 45 degrees with respect to the first side or the second side, positioned at about 40 degrees with respect to the first side or the second side, positioned at about 35 degrees with respect to the first side or the second side, positioned at about 30 degrees with respect to the first side or the second side, positioned between about 105 degrees and about 110 degrees with respect to the first side or the second side, positioned between about 105 degrees and about 120 degrees with respect to the first side or the second side, positioned between about 105 degrees and about 130 degrees with respect to the first side or the second side, positioned between about 105 degrees and about 140 degrees with respect to the first side or the second side, positioned between about 105 degrees and about 150 degrees with respect to the first side or the second side, positioned between about 105 degrees and about 160 degrees with respect to the first side or the second side, positioned between about 105 degrees and about 170 degrees with respect to the first side or the second side, positioned at about 105 degrees with respect to the first side or the second side, positioned at about 110 degrees with respect to the first side or the second side, positioned at about 115 degrees with respect to the first side or the second side, positioned at about 120 degrees with respect to the first side or the second side, positioned at about 125 degrees with respect to the first side or the second side, positioned at about 130 degrees with respect to the first side or the second side, positioned at about 135 degrees with respect to the first side or the second side, positioned at about 140 degrees with respect to the first side or the second side, positioned at about 145 degrees with respect to the first side or the second side, positioned at about 150 degrees with respect to the first side or the second side, positioned at about 155 degrees with respect to the first side or the second side, positioned at about 160 degrees with respect to the first side or the second side, positioned at about 165 degrees with respect to the first side or the second side, positioned at about 170 degrees with respect to the first side or the second side, and positioned at about 175 degrees with respect to the first side or the second side.

3. The percussion instrument of claim 1, wherein the releasable connection comprises at least one of: a screw; a threaded connection; a snap or press fit connection and a friction fit connection.

4. The percussion instrument of claim 1, wherein at least one of:

(i) the first hole of the at least two holes includes at least one recess or bore disposed or located substantially at an end of the first hole, the at least one recess or bore being sized and shaped to receive at least a portion of at least one of the first grip plate and the second grip plate therein such that the at least one recess or bore operates to permit the first grip plate or the second grip plate to be positioned at least one of: (a) closer to each other than when not having the at least one recess or bore; and (b) closer to the surface of the body of the percussion instrument;

(ii) the second hole of the at least two holes includes at least one recess or bore disposed or located substantially at an end of the first hole, the at least one recess or bore being sized and/or shaped to receive at least a portion of at least one of the first grip plate and the second grip plate therein such that the at least one recess or bore operates to permit the first grip plate and/or the second grip plate to be positioned at least one of: (a) closer to each other than when not having the at least one recess or bore; and (b) closer to the surface of the body of the percussion instrument;

(iii) the first hole of the at least two holes includes at least one of: (a) a first recess or bore of the at least one recess or bore at a first end of the first hole operating to permit at least a portion of the first grip plate to be disposed therein; and (b) a second recess or bore of the at least one recess or bore at a second end of the first hole operating to permit at least a portion of the second grip plate to be disposed therein; and (iv) the second hole of the at least two holes includes at least one of: (a) a first recess or bore of the at least one recess or bore at a first end of the first hole operating to permit at least a portion of the first grip plate to be disposed therein; and (b) a second recess or bore of the at least one recess or bore at a second end of the first hole operating to permit at least a portion of the second grip plate to be disposed therein.

5. The percussion instrument of claim 1, wherein at least one of:

(i) at least one of the first grip plate and the second grip plate includes a pad thereon, the pad operating to provide an ergonomic surface for gripping at least the at least one grasping mechanism of the percussion instrument;

(ii) the pad includes at least one surface that is at least one of: curved, sloped, chamfered, convex, concave, rounded, substantially flat, recessed, parallel or substantially parallel to the longitudinal axis of the body, and disposed at an angle that is not parallel or substantially parallel to the longitudinal axis of the body;

(iii) at least one of the first grip plate and the second grip plate includes at least one surface that is at least one of: curved, sloped, chamfered, convex, concave, rounded, substantially flat, recessed, parallel or substantially parallel to the longitudinal axis of the body, and disposed at an angle that is not parallel or substantially parallel to the longitudinal axis of the body;

(iv) the first grip plate and the second grip plate each include a pad thereon, the pad operating to provide an ergonomic surface for gripping at least the at least one grasping mechanism of the percussion instrument;

(v) the first grip plate and the second grip plate each include gripping surfaces thereon, the gripping surface of the first grip plate being substantially parallel or parallel to the gripping surface of the second grip plate; and (vi) the pad of the first grip plate and the pad of the second grip plate each including gripping surfaces thereon, the gripping surface of the pad of the first grip plate being substantially parallel or parallel to the gripping surface of the pad of the second grip plate.

6. The percussion instrument of claim 1, wherein the first hole and/or the second hole of the at least two holes are sized and shaped to permit the at least one grasping mechanism or the compliance mechanism to be positioned therein such that a zone of space of a predetermined size is located between the first hole of the at least two holes and/or the second hole of the at least two holes and the at least one grasping mechanism or the compliance mechanism, thereby permitting the at least one grasping mechanism or the compliance mechanism to move freely within the first hole of the at least two holes and/or the second hole of the at least two holes.

7. The percussion instrument of claim 1, wherein:

at least one of the first and second grip plates has a first substantially flat or flat surface facing the body, a second surface or perimeter wall extending from the flat surface facing the body at a right angle or at an angle that is about 90 degrees, a third surface extending from the second surface or perimeter wall, the third surface being sloped or tapered and extending to a fourth flat surface, the fourth flat surface having a length or a diameter that is smaller or shorter than the length or the diameter of the longest section of the at least one of the first and second grip plates.

8. The percussion instrument of claim 1, wherein (iii) at least a portion of the at least one shaft of the at least one grasping mechanism is in contact with at least a portion of an inside wall of one of the first hole and the second hole of the at least two holes such that the at least one shaft is substantially stationary or fixed in a predetermined position within the same one of the first hole and the second hole of the at least two holes.

9. A percussion instrument comprising:

a body having a longitudinal axis extending from a butt end to a striking end thereof and at least two holes extending through the thickness of the body substantially along and/or through a respective axis that is different from the longitudinal axis and that is different from the axis of the other hole of the at least two holes; and at least one grasping mechanism having a first grip plate at a first end thereof and a second grip plate at a second end thereof, at least one shaft extending from the first grip plate through a first hole of the at least two holes in the body to the second grip plate, and a releasable connection between the first grip plate and the second grip plate such that the at least one grasping mechanism operates to be positioned in the first hole of the at least two holes and the first grip plate and the second grip plate operate to be disconnected from each other and re-connected to each other such that the at least one grasping mechanism operates to be positioned in a second hole of the at least two holes or re-positioned in the first hole of the at least two holes, the first hole extending through the thickness of the body and disposed at least one of: at a right angle in relation to the longitudinal axis, at substantially a right angle in relation to the longitudinal axis, transversely to the longitudinal axis, substantially transversely to the longitudinal axis, at an angle that is about ninety degrees with respect to the body and at an angle that is ninety degrees with respect to the body, the second hole of the at least two holes extending through the thickness of the body and disposed at least one of: at an angle different from the angle of the first hole, at an angle that is not a right angle in relation to the longitudinal axis, at an angle that is not substantially a right angle in relation to the longitudinal axis, not transversely to the longitudinal axis, not substantially transversely to the longitudinal axis, at an angle other than about ninety degrees with respect to the body and at an angle other than ninety degrees with respect to the body.

10. The percussion instrument of claim 9, wherein:

(i) the body includes at least a first side extending between the butt end and the striking end of the body and at least a second side extending between the butt end and the striking end of the body;

(ii) the angle of the first hole of the at least two holes is at least one of: positioned between about 80 degrees and about 100 degrees with respect to the first side, the second side or the longitudinal axis of the body; positioned at about 90 degrees with respect to the first side, the second side or the longitudinal axis of the body; positioned at substantially 90 degrees with respect to the first side, the second side or the longitudinal axis of the body and positioned at 90 degrees with respect to the first side, the second side or the longitudinal axis of the body; and (iii) the angle of the second hole of the at least two holes is at least one of: positioned between about 80 degrees and about 45 degrees with respect to the first side or the second side, positioned between about 80 degrees and about 40 degrees with respect to the first side or the second side, positioned between about 70 degrees and about 45 degrees with respect to the first side or the second side, positioned between about 60 degrees and about 45 degrees with respect to the first side or the second side, positioned between about 50 degrees and about 45 degrees with respect to the first side or the second side, positioned at about 80 degrees with respect to the first side or the second side, positioned at about 75 degrees with respect to the first side or the second side, positioned at about 70 degrees with respect to the first side or the second side, positioned at about 65 degrees with respect to the first side or the second side, positioned at about 60 degrees with respect to with respect to the first side or the second side, positioned at about 55 degrees with respect to with respect to the first side or the second side, positioned at about 50 degrees with respect to the first side or the second side, positioned at about 45 degrees with respect to the first side or the second side, positioned at about 40 degrees with respect to the first side or the second side, positioned at about 35 degrees with respect to the first side or the second side, positioned at about 30 degrees with respect to the first side or the second side, positioned between about 105 degrees and about 110 degrees with respect to the first side or the second side, positioned between about 105 degrees and about 120 degrees with respect to the first side or the second side, positioned between about 105 degrees and about 130 degrees with respect to the first side or the second side, positioned between about 105 degrees and about 140 degrees with respect to the first side or the second side, positioned between about 105 degrees and about 150 degrees with respect to the first side or the second side, positioned between about 105 degrees and about 160 degrees with respect to the first side or the second side, positioned between about 105 degrees and about 170 degrees with respect to the first side or the second side, positioned at about 105 degrees with respect to the first side or the second side, positioned at about 110 degrees with respect to the first side or the second side, positioned at about 115 degrees with respect to the first side or the second side, positioned at about 120 degrees with respect to the first side or the second side, positioned at about 125 degrees with respect to the first side or the second side, positioned at about 130 degrees with respect to the first side or the second side, positioned at about 135 degrees with respect to the first side or the second side, positioned at about 140 degrees with respect to the first side or the second side, positioned at about 145 degrees with respect to the first side or the second side, positioned at about 150 degrees with respect to the first side or the second side, positioned at about 155 degrees with respect to the first side or the second side, positioned at about 160 degrees with respect to the first side or the second side, positioned at about 165 degrees with respect to the first side or the second side, positioned at about 170 degrees with respect to the first side or the second side, and positioned at about 175 degrees with respect to the first side or the second side.

11. The percussion instrument of claim 9, wherein the releasable connection comprises at least one of: a screw; a threaded connection; a snap or press fit connection and a friction fit connection.

12. The percussion instrument of claim 9, wherein at least one of:

(i) the first hole of the at least two holes includes at least one recess or bore disposed or located substantially at an end of the first hole, the at least one recess or bore being sized and shaped to receive at least a portion of at least one of the first grip plate and the second grip plate therein such that the at least one recess or bore operates to permit the first grip plate and the second grip plate to be positioned at least one of: (a) closer to each other than when not having the at least one recess or bore; and (b) closer to the surface of the body of the percussion instrument;

(ii) the second hole of the at least two holes includes at least one recess or bore disposed or located substantially at an end of the first hole, the at least one recess or bore being sized and shaped to receive at least a portion of at least one of the first grip plate and the second grip plate therein such that the at least one recess or bore operates to permit the first grip plate and/or the second grip plate to be positioned at least one of: (a) closer to each other than when not having the at least one recess or bore; and (b) closer to the surface of the body of the percussion instrument;

(iii) the first hole of the at least two holes includes at least one of: (a) a first recess or bore of the at least one recess or bore at a first end of the first hole operating to permit at least a portion of the first grip plate to be disposed therein; and (b) a second recess or bore of the at least one recess or bore at a second end of the first hole operating to permit at least a portion of the second grip plate to be disposed therein; and (iv) the second hole of the at least two holes includes at least one of: (a) a first recess or bore of the at least one recess or bore at a first end of the first hole operating to permit at least a portion of the first grip plate to be disposed therein; and (b) a second recess or bore of the at least one recess or bore at a second end of the first hole operating to permit at least a portion of the second grip plate to be disposed therein.

13. The percussion instrument of claim 9, wherein at least one of:

(i) at least one of the first grip plate and the second grip plate includes a pad thereon, the pad operating to provide an ergonomic surface for gripping at least the at least one grasping mechanism of the percussion instrument;

(ii) the pad includes at least one surface that is at least one of: curved, sloped, chamfered, convex, concave, rounded, substantially flat, recessed, parallel or substantially parallel to the longitudinal axis of the body, and disposed at an angle that is not parallel or substantially parallel to the longitudinal axis of the body;

(iii) at least one of the first grip plate and the second grip plate includes at least one surface that is at least one of: curved, sloped, chamfered, convex, concave, rounded, substantially flat, recessed, parallel or substantially parallel to the longitudinal axis of the body, and disposed at an angle that is not parallel or substantially parallel to the longitudinal axis of the body;

(iv) the first grip plate and the second grip plate each include a pad thereon, the pad operating to provide an ergonomic surface for gripping at least the at least one grasping mechanism of the percussion instrument;

(v) the first grip plate and the second grip plate each include gripping surfaces thereon, the gripping surface of the first grip plate being substantially parallel or parallel to the gripping surface of the second grip plate; and (vi) the pad of the first grip plate and the pad of the second grip plate each including gripping surfaces thereon, the gripping surface of the pad of the first grip plate being substantially parallel or parallel to the gripping surface of the pad of the second grip plate.

14. The percussion instrument of claim 9, wherein the first hole of the at least two holes or the second hole of the at least two holes is sized and shaped to permit the at least one grasping mechanism to be positioned therein such that a zone of space of a predetermined size is located between the first hole of the at least two holes and/or the second hole of the at least two holes and the at least one grasping mechanism, thereby permitting the at least one grasping mechanism to move freely within the first hole of the at least two holes and/or the second hole of the at least two holes.

15. The percussion instrument of claim 9, wherein at least one of the first and second grip plates has a first substantially flat or flat surface facing the body, a second surface or perimeter wall extending from the flat surface facing the body at a right angle or at an angle that is about 90 degrees, a third surface extending from the second surface or perimeter wall, the third surface being sloped and/or tapered and extending to a fourth flat surface, the fourth flat surface having a length or a diameter that is smaller or shorter than the length or the diameter of the longest section of the at least one of the first and second grip plates.

16. The percussion instrument of claim 9, wherein at least a portion of the at least one shaft of the at least one grasping mechanism is in contact with at least a portion of an inside wall of one of the first hole and the second hole of the at least two holes such that the at least one shaft is substantially stationary or fixed in a predetermined position within the same one of the first hole and the second hole of the at least two holes.

17. A percussion instrument comprising:

a body having a longitudinal axis extending from a butt end to a striking end thereof and at least two holes extending through the thickness of the body substantially along or through a respective axis that is different from the longitudinal axis and that is different from the axis of the other hole of the at least two holes; and at least one hinge having a first disc at a first end thereof and a second disc at a second end thereof, at least one shaft extending from the first disc through a first hole of the at least two holes in the body to the second disc, and a releasable connection between the first disc and the second disc such that the at least one hinge operates to be positioned in the first hole of the at least two holes and the first disc and the second disc operate to be disconnected from each other and re-connected to each other such that the at least one hinge operates to be positioned in a second hole of the at least two holes or re-positioned in the first hole of the at least two holes, the first hole extending through the thickness of the body and disposed at least one of: at a right angle in relation to the longitudinal axis, at substantially a right angle in relation to the longitudinal axis, transversely to the longitudinal axis, substantially transversely to the longitudinal axis, at an angle that is about ninety degrees with respect to the body and at an angle that is ninety degrees with respect to the body, the second hole of the at least two holes extending through the thickness of the body and disposed at least one of: at an angle different from the angle of the first hole, at an angle that is not a right angle in relation to the longitudinal axis, at an angle that is not substantially a right angle in relation to the longitudinal axis, not transversely to the longitudinal axis, not substantially transversely to the longitudinal axis, at an angle other than about ninety degrees with respect to the body and at an angle other than ninety degrees with respect to the body.

18. The percussion instrument of claim 17, wherein:

(i) the body includes at least a first side extending between the butt end and the striking end of the body and at least a second side extending between the butt end and the striking end of the body;

(ii) the angle of the first hole of the at least two holes is at least one of: positioned between about 80 degrees and about 100 degrees with respect to the first side, the second side or the longitudinal axis of the body; positioned at about 90 degrees with respect to the first side, the second side or the longitudinal axis of the body; positioned at substantially 90 degrees with respect to the first side, the second side or the longitudinal axis of the body and positioned at 90 degrees with respect to the first side, the second side or the longitudinal axis of the body; and (iii) the angle of the second hole of the at least two holes is at least one of: positioned between about 80 degrees and about 45 degrees with respect to the first side or the second side, positioned between about 80 degrees and about 40 degrees with respect to the first side or the second side, positioned between about 70 degrees and about 45 degrees with respect to the first side or the second side, positioned between about 60 degrees and about 45 degrees with respect to the first side or the second side, positioned between about 50 degrees and about 45 degrees with respect to the first side or the second side, positioned at about 80 degrees with respect to the first side or the second side, positioned at about 75 degrees with respect to the first side or the second side, positioned at about 70 degrees with respect to the first side or the second side, positioned at about 65 degrees with respect to the first side or the second side, positioned at about 60 degrees with respect to with respect to the first side or the second side, positioned at about 55 degrees with respect to with respect to the first side or the second side, positioned at about 50 degrees with respect to the first side or the second side, positioned at about 45 degrees with respect to the first side or the second side, positioned at about 40 degrees with respect to the first side or the second side, positioned at about 35 degrees with respect to the first side or the second side, positioned at about 30 degrees with respect to the first side or the second side, positioned between about 105 degrees and about 110 degrees with respect to the first side or the second side, positioned between about 105 degrees and about 120 degrees with respect to the first side or the second side, positioned between about 105 degrees and about 130 degrees with respect to the first side or the second side, positioned between about 105 degrees and about 140 degrees with respect to the first side or the second side, positioned between about 105 degrees and about 150 degrees with respect to the first side or the second side, positioned between about 105 degrees and about 160 degrees with respect to the first side or the second side, positioned between about 105 degrees and about 170 degrees with respect to the first side or the second side, positioned at about 105 degrees with respect to the first side or the second side, positioned at about 110 degrees with respect to the first side or the second side, positioned at about 115 degrees with respect to the first side or the second side, positioned at about 120 degrees with respect to the first side or the second side, positioned at about 125 degrees with respect to the first side or the second side, positioned at about 130 degrees with respect to the first side or the second side, positioned at about 135 degrees with respect to the first side or the second side, positioned at about 140 degrees with respect to the first side or the second side, positioned at about 145 degrees with respect to the first side or the second side, positioned at about 150 degrees with respect to the first side or the second side, positioned at about 155 degrees with respect to the first side or the second side, positioned at about 160 degrees with respect to the first side or the second side, positioned at about 165 degrees with respect to the first side or the second side, positioned at about 170 degrees with respect to the first side or the second side, and positioned at about 175 degrees with respect to the first side or the second side.

19. The percussion instrument of claim 17, wherein the releasable connection comprises at least one of: a screw; a threaded connection; a snap or press fit connection and a friction fit connection.

20. The percussion instrument of claim 17, wherein at least one of:

(i) the first hole of the at least two holes includes at least one recess or bore disposed or located substantially at an end of the first hole, the at least one recess or bore being sized and shaped to receive at least a portion of at least one of the first disc and the second disc therein such that the at least one recess or bore operates to permit the first disc or the second disc to be positioned at least one of: (a) closer to each other than when not having the at least one recess or bore; and (b) closer to the surface of the body of the percussion instrument;

(ii) the second hole of the at least two holes includes at least one recess or bore disposed or located substantially at an end of the first hole, the at least one recess or bore being sized and shaped to receive at least a portion of at least one of the first disc and the second disc therein such that the at least one recess or bore operates to permit the first disc or the second disc to be positioned at least one of: (a) closer to each other than when not having the at least one recess or bore; and (b) closer to the surface of the body of the percussion instrument;

(iii) the first hole of the at least two holes includes at least one of: (a) a first recess or bore of the at least one recess or bore at a first end of the first hole operating to permit at least a portion of the first disc to be disposed therein; and (b) a second recess or bore of the at least one recess or bore at a second end of the first hole operating to permit at least a portion of the second disc to be disposed therein; and (iv) the second hole of the at least two holes includes at least one of: (a) a first recess or bore of the at least one recess or bore at a first end of the first hole operating to permit at least a portion of the first disc to be disposed therein; and (b) a second recess or bore of the at least one recess or bore at a second end of the first hole operating to permit at least a portion of the second disc to be disposed therein.

21. The percussion instrument of claim 17, wherein at least one of:

(i) at least one of the first disc and the second disc includes a pad thereon, the pad operating to provide an ergonomic surface for gripping at least the at least one hinge of the percussion instrument;

(ii) the pad includes at least one surface that is at least one of: curved, sloped, chamfered, convex, concave, rounded, substantially flat, recessed, parallel or substantially parallel to the longitudinal axis of the body, and disposed at an angle that is not parallel or substantially parallel to the longitudinal axis of the body;

(iii) at least one of the first disc and the second disc includes at least one surface that is at least one of: curved, sloped, chamfered, convex, concave, rounded, substantially flat, recessed, parallel or substantially parallel to the longitudinal axis of the body, and disposed at an angle that is not parallel or substantially parallel to the longitudinal axis of the body;

(iv) the first disc and the second disc each include a pad thereon, the pad operating to provide an ergonomic surface for gripping at least the at least one hinge of the percussion instrument;

(v) the first disc and the second disc each include gripping surfaces thereon, the gripping surface of the first disc being substantially parallel or parallel to the gripping surface of the second disc; and (vi) the pad of the first disc and the pad of the second disc each including gripping surfaces thereon, the gripping surface of the pad of the first disc being substantially parallel or parallel to the gripping surface of the pad of the second disc.

22. The percussion instrument of claim 17, wherein the first hole of the at least two holes or the second hole of the at least two holes is sized and shaped to permit the at least one hinge to be positioned therein such that a zone of space of a predetermined size is located between the first hole of the at least two holes or the second hole of the at least two holes and the at least one hinge, thereby permitting the at least one hinge to move freely within the first hole of the at least two holes or the second hole of the at least two holes.

23. The percussion instrument of claim 17, wherein at least one of the first and second discs has a first substantially flat or flat surface facing the body, a second surface or perimeter wall extending from the flat surface facing the body at a right angle or at an angle that is about 90 degrees, a third surface extending from the second surface or perimeter wall, the third surface being sloped or tapered and extending to a fourth flat surface, the fourth flat surface having a length or a diameter that is smaller or shorter than the length or the diameter of the longest section of the at least one of the first and second discs.

24. The percussion instrument of claim 17, wherein at least a portion of the at least one shaft of the at least one hinge is in contact with at least a portion of an inside wall of one of the first hole and the second hole of the at least two holes such that the at least one shaft is substantially stationary or fixed in a predetermined position within the same one of first hole and the second hole of the at least two holes.

25. A percussion instrument comprising:

a body having a longitudinal axis extending from a butt end to a striking end thereof and at least one hole extending through the thickness of the body substantially along and/or through an axis that is different from the longitudinal axis; and a grasping mechanism having a first grip plate at a first end thereof and a second grip plate at a second end thereof, and a fastener extending from the first grip plate through the hole in the body to the second grip plate, wherein at least one of:

(i) the fastener includes a first shaft connected to the first grip plate, a second shaft connected to the second grip plate, and a compliance mechanism located between the first and second shafts, the compliance mechanism operating to enable the first and second grip plates to be moved closer together in response to a compressive force applied to the at least one grasping mechanism; and (ii) the fastener comprises a compliance mechanism disposed between the first and second grip plates, the compliance mechanism operating to enable the first and second grip plates to be moved closer together in response to a compressive force applied to the at least one grasping mechanism.

26. The percussion instrument of claim 25, further comprising first and second frictional contact devices, wherein at least one of:

(i) the first frictional contact device comprises a first O-ring and the second frictional contact device comprises a second O-ring;

(ii) the first and second frictional contact devices are located between an outside surface of the body and the inside surfaces of the first and second grip plates, respectively;

(iii) the first and second frictional contact devices are located between the body and the first and second grip plates, respectively;

(iv) the first and second frictional contact devices comprise an inside surface or portion of the first grip plate and an inside surface or portion of the second grip plate, respectively;

(v) the first and second grip plates each include a groove disposed on, and in communication with, the inside surfaces of the first and second grip plates, the groove of the first grip plate operating to house the respective first frictional contact device therein and the groove of the second grip plate operating to house the respective second frictional contact device therein; and (vi) the first and second frictional contact devices operate to provide a braking function for slowing and/or stopping the relative motion between the body and the first and second grip plates and/or the grasping mechanism when at least one of the first frictional contact device and the second frictional contact device is brought into contact with the body of drumstick.

* * * * *